US006585843B2

(12) United States Patent
Nickell et al.

(10) Patent No.: US 6,585,843 B2
(45) Date of Patent: Jul. 1, 2003

(54) ANTI-STATIC, ANTI-CORROSION, AND/OR ANTI-MICROBIAL FILMS, FABRICS, AND ARTICLES

(75) Inventors: Craig Alan Nickell, Sherman, TX (US); Norwin C. Derby, West Tawakoni, TX (US); Bradley Matthew Eisenbarth, Sherman, TX (US)

(73) Assignee: Super Sack Mfg. Corp., Dallas, TX (US)

( * ) Notice: Subject to any disclaimer, the term of this patent is extended or adjusted under 35 U.S.C. 154(b) by 181 days.

(21) Appl. No.: 09/730,528

(22) Filed: Dec. 6, 2000

(65) Prior Publication Data

US 2001/0000097 A1 Apr. 5, 2001

Related U.S. Application Data

(60) Continuation-in-part of application No. 09/656,249, filed on Sep. 6, 2000, which is a continuation of application No. 09/133,398, filed on Aug. 13, 1998, now abandoned, which is a division of application No. 08/474,378, filed on Jun. 7, 1995, now abandoned, which is a continuation-in-part of application No. 08/411,460, filed on Mar. 28, 1995, now abandoned, which is a continuation of application No. 08/334,447, filed on Nov. 3, 1994, now abandoned, which is a continuation of application No. 08/043,935, filed on Apr. 8, 1993, now abandoned, which is a division of application No. 07/819,177, filed on Jan. 10, 1992, now Pat. No. 5,244,281.

(51) Int. Cl.[7] ..... B32B 31/04; B32B 31/30

(52) U.S. Cl. ..... 156/244.11; 156/148; 156/244.18; 156/264; 383/116

(58) Field of Search ..... 156/148, 244.11, 156/244.18, 244.19, 264, 256; 383/109, 116, 117; 426/106, 119

(56) References Cited

U.S. PATENT DOCUMENTS

| | | | |
|---|---|---|---|
| 546,168 | A | 9/1895 | Lobdell |
| 616,249 | A | 12/1898 | Nickerson |
| 733,542 | A | 7/1903 | Converse |
| 1,335,607 | A | 3/1920 | Salisbury |

(List continued on next page.)

FOREIGN PATENT DOCUMENTS

WO PCT/US82/00314 3/1982

OTHER PUBLICATIONS

Versicon Conductive Polymer, Product Data Sheet, 1996, 8 pgs.

Plastics Get Wired, Scientific American, Jul. 1995, pp. 2–7.

Olin Chemicals, Biocides Technical Product Information, 1996, pp. 1–6.

Microban Products Company, Microban Brochure for the Food–Service Industry, 1994, 18 pgs.

*Primary Examiner*—Michael W. Ball
*Assistant Examiner*—Todd J. Kilkenny
(74) *Attorney, Agent, or Firm*—Michael A. O'Neil

(57) ABSTRACT

A flexible, collapsible receptacle (hereinafter bag) for handling flowable materials which is fabricated from polymeric fabric and which provides (1) improved static control; (2) improved corrosion inhibition; and/or (3) improved microbial inhibition characteristics. The bag is manufactured by providing a quantity of thermoplastic resin having a predetermined conductivity (anti-static resin); forming the anti-static resin into relatively long, narrow, thin lengths of anti-static material (anti-static tapes); weaving the anti-static tapes into an anti-static fabric having a predetermined, controlled electrical resistivity; cutting the anti-static fabric into a plurality of pieces; and joining the pieces of anti-static fabric together thereby constructing the anti-static bag. Similar methods are disclosed for manufacturing bags having improved corrosion inhibition and/or improved microbial inhibition characteristics.

7 Claims, 25 Drawing Sheets

U.S. PATENT DOCUMENTS 1,815,106 A 7/1931 Jostes
2,009,511 A 7/1935 Nydegger
2,047,095 A 7/1936 Booth
2,096,161 A 10/1937 Curran
2,301,128 A 11/1942 Landefeld
2,314,876 A 3/1943 Greene
2,361,943 A 11/1944 Lissoglio et al.
2,507,939 A 5/1950 Smith
2,691,998 A 10/1954 Stucker
2,740,445 A 4/1956 Fornell
2,969,102 A 1/1961 Cunningham
3,044,438 A 7/1962 Osswald et al.
3,072,512 A 1/1963 Dalle
3,096,013 A 7/1963 Kugler
3,282,757 A 11/1966 Brussee
3,328,226 A 6/1967 Wiley
3,374,929 A 3/1968 Silfverskiold
3,430,815 A 3/1969 Weimer et al.
3,445,055 A 5/1969 Port et al.
3,531,365 A 9/1970 Melin
3,540,356 A 11/1970 Lecomte
3,555,170 A 1/1971 Petzetakis
3,570,749 A 3/1971 Sato et al.
3,581,883 A 6/1971 Whitney
3,589,506 A 6/1971 Ford et al.
3,596,824 A 8/1971 Lemacher et al.
3,607,616 A 9/1971 Barbehenn et al.
3,620,774 A 11/1971 Ford et al.
3,623,937 A 11/1971 Gasaway
3,636,185 A 1/1972 Ruddell et al.
3,661,322 A 5/1972 Norman
3,666,585 A 5/1972 Barbehenn
3,671,383 A 6/1972 Sakata et al.
3,701,559 A 10/1972 Marino et al.
3,742,664 A 7/1973 Reding
3,754,053 A 8/1973 Kray et al.
3,754,063 A 8/1973 Schirmer
3,789,897 A 2/1974 Saito
3,798,115 A 3/1974 Hoffman et al.
3,827,471 A 8/1974 Gregory et al.
3,865,339 A 2/1975 Von Alven
3,874,989 A 4/1975 Stange et al.
3,893,595 A 7/1975 Khanna et al.
3,907,955 A 9/1975 Viennot
3,961,655 A 6/1976 Nattrass et al.
3,982,986 A 9/1976 Stone et al.
4,010,784 A 3/1977 Nattrass et al.
4,081,011 A 3/1978 Krause
4,107,458 A 8/1978 Razvi
4,113,146 A 9/1978 Williamson
4,143,796 A 3/1979 Williamson et al.
4,149,755 A 4/1979 Handleman et al.
4,194,652 A 3/1980 Williamson et al.
4,221,250 A 9/1980 Manerba
4,224,970 A 9/1980 Williamson et al.
4,230,763 A 10/1980 Skolnick
4,418,114 A 11/1983 Briggs et al.
4,457,456 A 7/1984 Derby et al.
4,467,005 A 8/1984 Pusch et al.
4,560,608 A 12/1985 Pusch et al.
4,597,102 A 6/1986 Nattrass
4,621,012 A 11/1986 Pusch
4,622,950 A 11/1986 Greenbaum
4,624,679 A 11/1986 McEntee
4,666,706 A 5/1987 Farquharson et al.
4,686,239 A 8/1987 Rei
4,692,494 A 9/1987 Sonenstein
4,759,473 A 7/1988 Derby et al.
4,833,008 A 5/1989 Derby
4,865,855 A 9/1989 Hansen et al.
5,024,792 A 6/1991 Havens
5,071,699 A 12/1991 Pappas et al.
5,092,683 A 3/1992 Wurr
5,094,847 A 3/1992 Yazaki et al.
5,100,943 A 3/1992 Katoh et al.
5,104,649 A 4/1992 Jansson et al.
5,114,984 A 5/1992 Branch et al.
5,151,122 A 9/1992 Atsumi et al.
5,158,766 A 10/1992 Greenwald et al.
5,180,585 A 1/1993 Jacobson et al.
5,244,281 A 9/1993 Wiliamson et al.
5,296,238 A 3/1994 Sugiura et al.
5,334,428 A 8/1994 Dobreski et al.
5,341,557 A 8/1994 Perlman
5,468,738 A 11/1995 Okabayashi et al.
5,527,570 A 6/1996 Addeo et al.
5,534,563 A 7/1996 Lin et al.
5,549,895 A 8/1996 Lyon et al.
5,554,373 A 9/1996 Seabrook et al.
5,554,673 A 9/1996 Shah
5,586,643 A 12/1996 Zabron et al.
5,705,092 A * 1/1998 Wellinghoff et al. ... 252/187.21
5,733,613 A 3/1998 Baecker
5,766,773 A 6/1998 Paulett et al.

* cited by examiner 164
200
194

164
200
164

164
200
184

164
200
174

194
200
162

184
200
162

164
200
162

174
200
162

164
200
192

174
200
194

174
200
164

174
200
184

174
200
174

194
200
172

184
200
172

164
200
172

174
200
172

174
200
192

184
200
194

184
200
164

184
200
184

184
200
174

194
200
182

184
200
182

164
200
182

174
200
182

184
200
192

ANTI-STATIC, ANTI-CORROSION, AND/OR ANTI-MICROBIAL FILMS, FABRICS, AND ARTICLES

RELATED APPLICATIONS

This application is a continuation-in-part of prior application Ser. No. 09/656,249, filed Sep. 6, 2000, which is a continuation of prior application Ser. No. 09/133,398 filed Aug. 13, 1998, now abandoned currently pending, which is a divisional of application Ser. No. 08/474,378 filed Jun. 7, 1995, now abandoned, which is a continuation-in-part Application under 37 C.F.R. §1.63 of application Ser. No. 08/411,460, filed Mar. 28, 1995, now abandoned, which is a continuation of application Ser. No. 08/334,447, filed on Nov. 3, 1994, now abandoned, which is a continuation of application Ser. No. 08/043,935 filed Apr. 8, 1993, now abandoned, which is a division of application Ser. No. 07/819,177 filed Jan. 10, 1992, now issued as U.S. Pat. No. 5,244,281.

TECHNICAL FIELD

The present invention relates to the manufacture of films, fabrics, and articles, and in particular to the manufacture of films, fabrics, and articles having (1) improved static electricity control; (2) improved corrosion inhibition; and/or (3) improved microbial inhibition characteristics.

BACKGROUND OF THE INVENTION

Over the past three decades there has been increasing interest in the use of flexible, collapsible containers (a/k/a bulk bags) for handling flowable materials such as chemicals, minerals, fertilizers, foodstuffs, grains and other agricultural products, etc. The advantages resulting from the use of such receptacles include relatively low weight, reduced cost, versatility and, in the case of reusable receptacles, low return freight costs.

Fabrics are often utilized in the construction of flexible, collapsible containers where strength, flexibility and durability are important. Originally, such containers were fabricated from natural fibers; more recently, however, synthetic fibers manufactured from polypropylene, polyethylene or other polymeric materials have come into almost exclusive use. The popularity of synthetic fibers can be attributed to the fact that they are generally stronger and more durable than their natural fiber counterparts.

Even with the advances in fabric construction resulting from the shift from natural to synthetic fibers, fabrics in general possess qualities that render their use in certain applications undesirable. For example, the friction that occurs as dry flowable materials are handled by fabric receptacles tends to cause a significant build-up and retention of static electric charge within the receptacle. Discharge of the generated static electric build-up is often difficult, if not impossible, to control because fabrics are generally not electrically conductive materials. However, controlled discharge is imperative as static electric potential poses a significant danger of fire or explosion resulting from a static generated electrical spark.

In an effort to address the undesirable static electric discharge characteristic of fabrics, bag manufacturers covered one side of the fabric with a metallic foil-like layer. An adhesive was applied between the layers to affix the foil-like layer to the plastic fabric. The foil-like layer was generally comprised of aluminum or some other electrically conductive metal. The foil-covered fabric was then used to construct the receptacle, for example, with the foil side of the fabric comprising the interior surface. The foil layer provided an electrically conductive surface exposed to the flowable materials through which static electricity generated during material handling was discharged to an appropriate ground.

While adequately discharging static electric build-up if undamaged, the foil layer was susceptible to abrasion, tearing and separation from the fabric layer through normal use of the receptacle. For example, in filling, transporting and/or emptying of foil-covered fabric receptacles, abrasion between the flowable material and the foil layer tended to cause the foil layer to tear and/or separate from the fabric layer. The cumulative effect of such abrasion quickly reduced the effectiveness of the foil layer as a static electric discharge surface. Furthermore, tearing of the foil often resulted in a release of foil particles and flakes from the fabric, thereby contaminating the contained flowable materials.

To address the problems experienced with foil-covered fabrics, U.S. Pat. No. 4,833,008, issued to Norwin C. Derby, discloses a metalized fabric comprised of a woven plastic base fabric laminated to a metalized plastic film. The plastic base fabric is preferably a woven polypropylene fabric, and the plastic film is preferably an extruded polypropylene film. The plastic film is metalized through a vapor deposition process whereby a thin film of electrically conductive material is deposited on one side of the plastic film. The woven plastic fabric and the metalized plastic film are then laminated together through use of a plastic adhesive. Unlike foil covered fabrics, the thin conductive layer deposited on the plastic film is not subject to tearing or flaking; however, it is susceptible to chemical reactions.

U.S. Pat. No. 5,244,281, issued to Norwin C. Derby, of which this application is a continuation-in-part, discloses bags made from the fabric disclosed in the Derby '008 Patent in combination with fabrics impregnated with anti-static compounds. The bags disclosed in the Derby '281 Patent provide satisfactory anti-static capabilities. However, the fabrics of the present invention provide enhanced performance, and bags made from the fabric can be less expensive to produce.

Other recognized problems in the use of flexible, collapsible receptacles include corrosion and/or microbial contamination of the flowable material contained therein. In addition to the improved static discharge control, the present invention provides both enhanced corrosion inhibition and enhanced microbial inhibition over prior art practices.

SUMMARY OF THE INVENTION

In accordance with its broader aspects, the present invention comprises a method of manufacturing a flexible intermediate bulk container having predetermined performance characteristics comprising the steps of providing a thermoplastic resin, providing a chemical agent comprising the predetermined performance characteristic, mixing the resin and the chemical agent, forming the mixture into a woven fabric, cutting the fabric into a plurality of pieces, and joining the pieces to form a flexible intermediate bulk container having the desired performance characteristic. More particularly, the present invention comprises a flexible, collapsible receptacle (a/k/a bulk bag) for handling flowable materials which is fabricated from polymeric fabric and which provides (1) improved static control; (2) improved corrosion inhibition; and/or (3) improved microbial inhibition characteristics as compared with the prior art. The bulk bag itself may have any of the numerous designs known in the art such as those taught by U.S. Pat. No. 4,457,456 issued to Norwin C. Derby, et al. and U.S. Pat. No. 4,194,652 issued to Robert R. Williamson, et al., the disclosures of which are incorporated herein by reference.

In accordance with a first embodiment of the invention, the fabric utilized for construction of the bulk bag has improved static control characteristics. An inorganic static control additive distributed by the American Telephone and Telegraph Company (AT&T) under the trademark STATIC INTERCEPT® and available as an anti-static material/thermoplastic resin mixture from Engineered Materials, Inc. of Buffalo Grove, Ill., is blended in concentrations and quantities determined by the desired resistivity range of the finished bag product with a thermoplastic resin such as polypropylene or polyethylene in predetermined quantities based on the desired flowability and melt properties of an anti-static resin feedstock.

The STATIC INTERCEPT® anti-static material utilized in the practice of the present invention is superior to the anti-static material disclosed in U.S. Pat. No. 5,071,699, issued to Pappas', et al., because the STATIC INTERCEPT® additive is inorganic, not fugitive, is effective in low concentrations and will not burn at extrusion temperatures.

The anti-static resin feedstock is extruded in at least six possible formats: (a) an anti-static layer extruded onto a polymeric fabric; (b) an anti-static layer extruded onto a polymeric film; (c) a co-extrusion comprising a layer of anti-static material and a layer of polymeric material; (d) an extruded anti-static film; (e) extruded anti-static tapes; and (f) extruded anti-static filaments.

The anti-static intermediate products identified above as (b), (c), and (d) are cut into long, narrow, thin strips (hereinafter referred to as "slit anti-static tapes"). The slit anti-static tapes and/or the extruded anti-static tapes, and/or the extruded anti-static filaments (collectively the "anti-static weavable members") are woven into an anti-static fabric. Alternatively, one or more of the anti-static weavable members are combined with conventional polymeric tapes and/or filaments for weaving into an anti-static grid fabric. Any of the anti-static fabrics may then be cut and sewn to form an anti-static bulk bag. Additionally, anti-static filaments and/or anti-static tapes and/or anti-static threads may be used in the sewing of the anti-static bulk bag.

Alternatively, anti-static film may be laminated on various base layers using a thermoplastic resin as a bonding agent to create an anti-static sheet. The base layers may include (a) conventional film; (b) anti-static film; (c) anti-microbial film; and/or (d) anti-corrosion film. The anti-static sheets are then slit into anti-static tapes and woven as previously described into an anti-static fabric or an anti-static grid fabric.

It is previously known to add carbon to a thermoplastic resin mixture, and then to extrude the carbon-bearing resin mixture into a film, slit the film into tapes, weave the tapes into fabric, and use the fabric in the construction of bulk bags. However, experience with carbon-loaded resins in manufacturing anti-static fabric for bag construction has identified two serious problems. First, the fabrics are not sufficiently conductive as to provide anti-static protection until the resin mixture includes approximately 25% carbon. At that point, the resin mixture in the resulting fabric becomes almost totally conductive. Thus, it has heretofore not been possible to control the conductivity of the resin mixture and the resistivity of the fabric within a predetermined range as required by a particular application of the invention. Second, the inclusion of 25% carbon in the resin mixture distorts the nature of the polymeric material to such an extent that the resulting tapes and the fabrics woven therefrom do not retain the strength that they otherwise would have provided.

The lamination process may be used to form additional layered configurations including: (a) a conventional film laminated onto an anti-static fabric; (b) an anti-microbial film laminated onto an anti-static fabric; (c) an anti-static film laminated onto an anti-static fabric; and (d) an anti-corrosion film laminated onto an anti-static fabric. In accordance with conventional practice, micropores may be formed in the film layer to provide access to the fabric layer, if desired. The laminated fabrics thus produced may be cut and sewn into a bulk bag as previously described.

An anti-static, conventional polymeric, or anti-microbial liner may be installed in an anti-static bulk bag fabricated in accordance with any of the foregoing combinations of anti-static materials. Alternatively, an anti-static liner or an anti-microbial liner may be installed in a bulk bag fabricated from conventional polymeric fabrics. A cover made from conventional, anti-static, or anti-microbial material may be used in conjunction with a bag fabricated from conventional or anti-static fabrics. Conductive lift loops for use in fabricating anti-static bags may be fabricated from any of the aforementioned anti-static materials.

In accordance with a second embodiment of the invention, the fabric utilized in the construction of bulk bags has improved corrosion inhibiting characteristics. An inorganic corrosion control additive distributed by AT&T under the trademark CORROSION INTERCEPT®, and available as an anti-corrosive material/thermoplastic resin mixture from Engineered Materials, Inc., of Buffalo Grove, Ill., is blended in concentrations and quantities determined by the desired corrosion inhibition range of the finished bag with a thermoplastic resin such as polypropylene or polyethylene in predetermined quantities based on the desired flowability and melt properties of an anti-corrosion resin feedstock. The anti-corrosion resin feedstock is then used in forming anti-corrosion fabrics, sheets and bulk bags in accordance with procedures similar to those described above in conjunction with anti-static fabrics, sheets and bulk bags. The corrosion inhibition additive reacts with and permanently neutralizes corrosive gases thereby cleansing air trapped in the bulk bag of substantially all corrosive gases.

In accordance with a third embodiment of the invention, the fabric utilized for construction of the bulk bag has improved microbial inhibiting characteristics. A microbial inhibitor additive is distributed by Microban Products Company of Huntersville, N.C., under the trademark MICROBAN®. An alternative microbial inhibitor additive is distributed by HealthShield Technologies LLC of Westport, Conn., under the trademark HealthShield™.

The microbial inhibitor is blended in concentrations and quantities determined by the desired microbial inhibition range of the finished bulk bag with a thermoplastic resin such as polypropylene or polyethylene in predetermined quantities based on the desired flowability and melt properties of an anti-microbial resin feedstock. The anti-microbial feedstock is then used in forming anti-microbial fabrics, sheets and bags in accordance with procedures similar to those described above in conjunction with anti-static fabrics, sheets and bulk bags. The microbial additive is mixed evenly throughout the polymeric material and migrates to the surface of the finished product on demand.

In accordance with a fourth embodiment of the invention, films, fabrics, and coatings are manufactured from polymeric materials including an anti-microbial agent. The preferred anti-microbial agent is "HealthShield"™, which is an anti-microbial compound combining silver with a naturally occurring inorganic ceramic that facilitates continuous, controlled release of ionic silver over an extended period of time. Films incorporating the fourth embodiment of the invention may be used, for example, as release sheets for hamburger patties and other food items. Films incorporating the fourth embodiment of the invention may also be used in the manufacture of liners for bulk bags. Fabrics incorporating the fourth embodiment of the invention may be used in the manufacture of bulk bags and in other applications. Coatings incorporating the fourth embodiment of the invention may be used in the manufacture of bulk bags and in other applications.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1A:
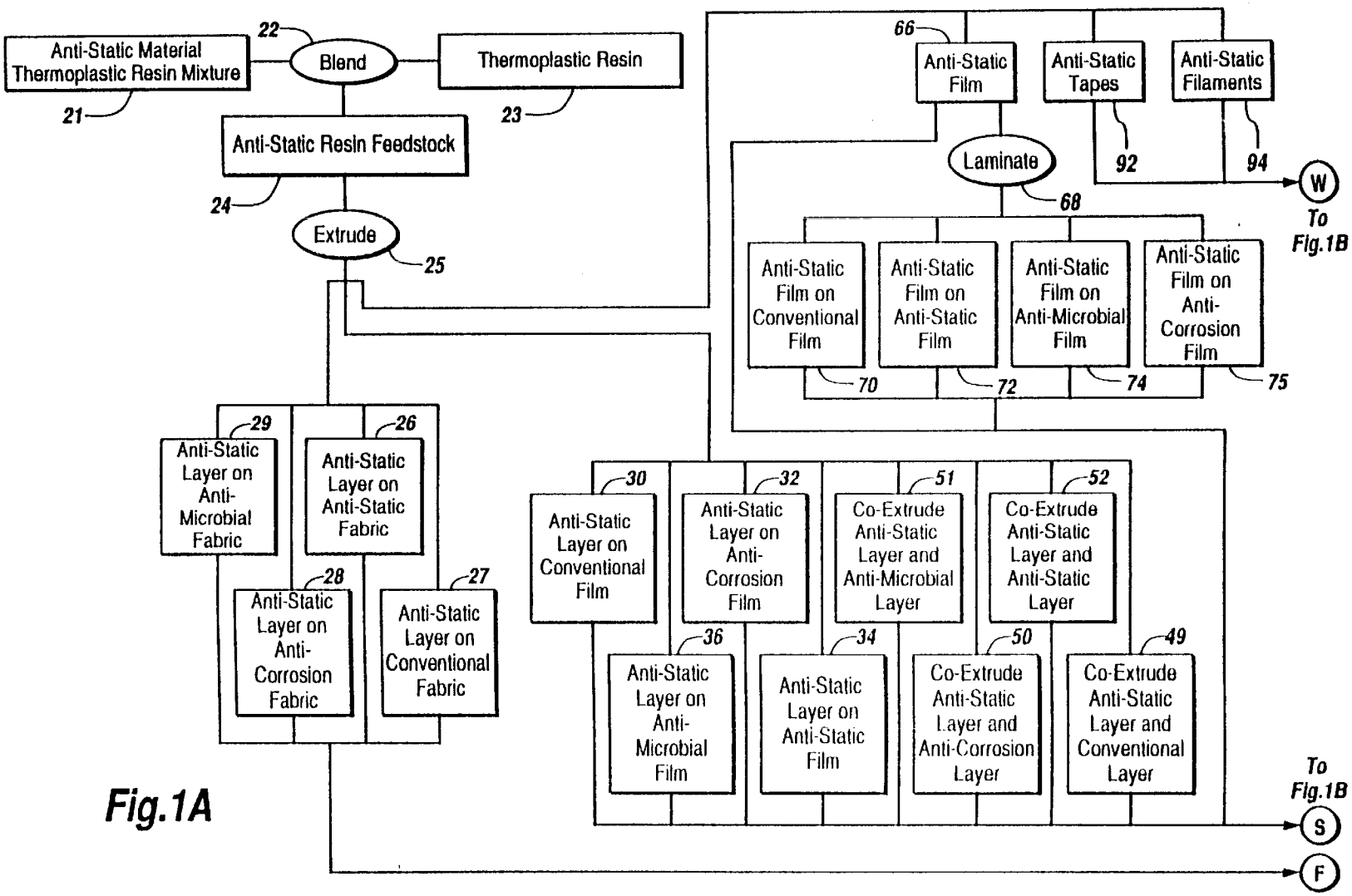
FIGS. 1A, 1B, and 1C comprise a flow chart illustrating numerous alternative methods for producing fabrics, fabric bags, fabric lift loops, bag liners and bag covers incorporating improved static discharge control.
Figure 1B:
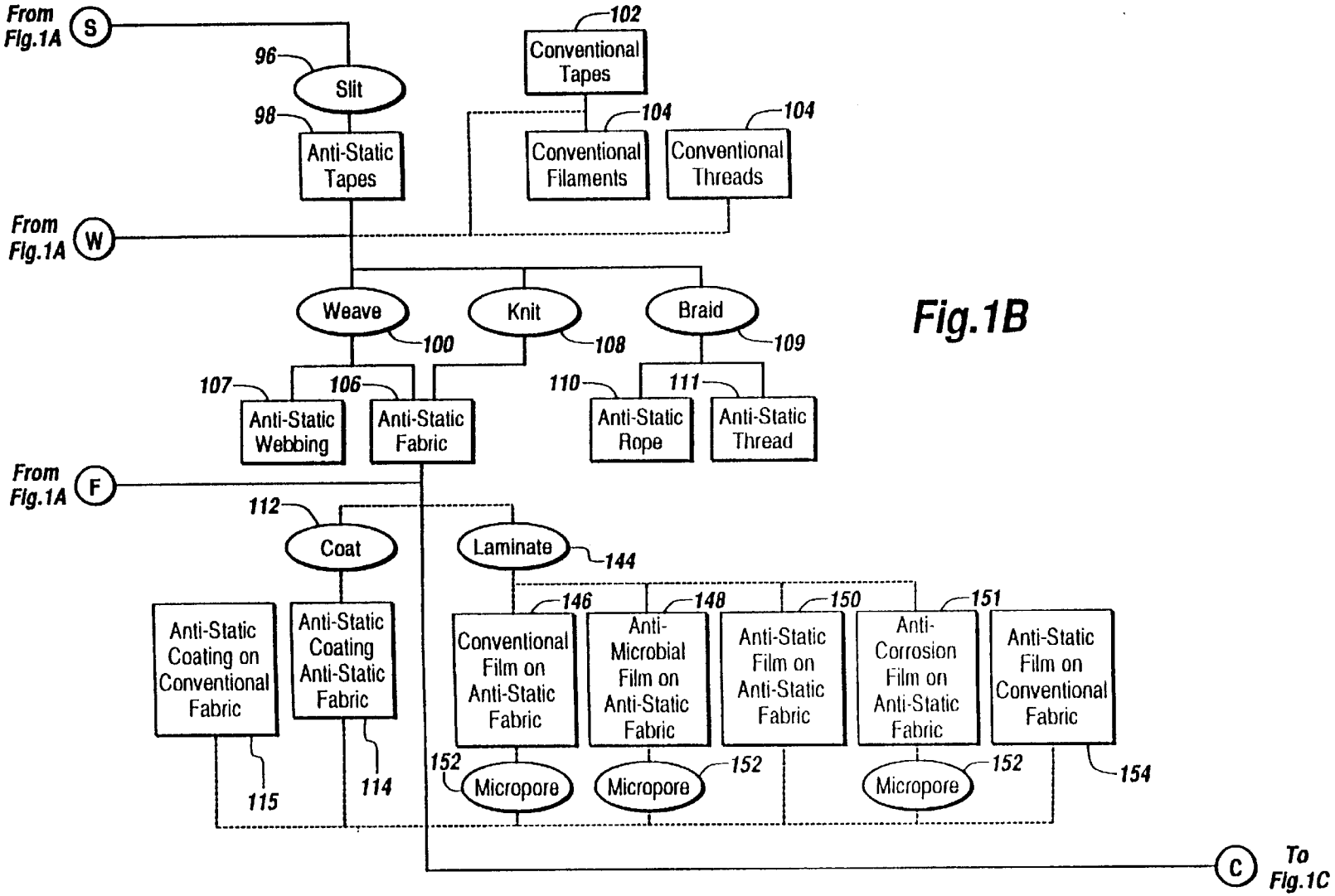
Figure 1C:
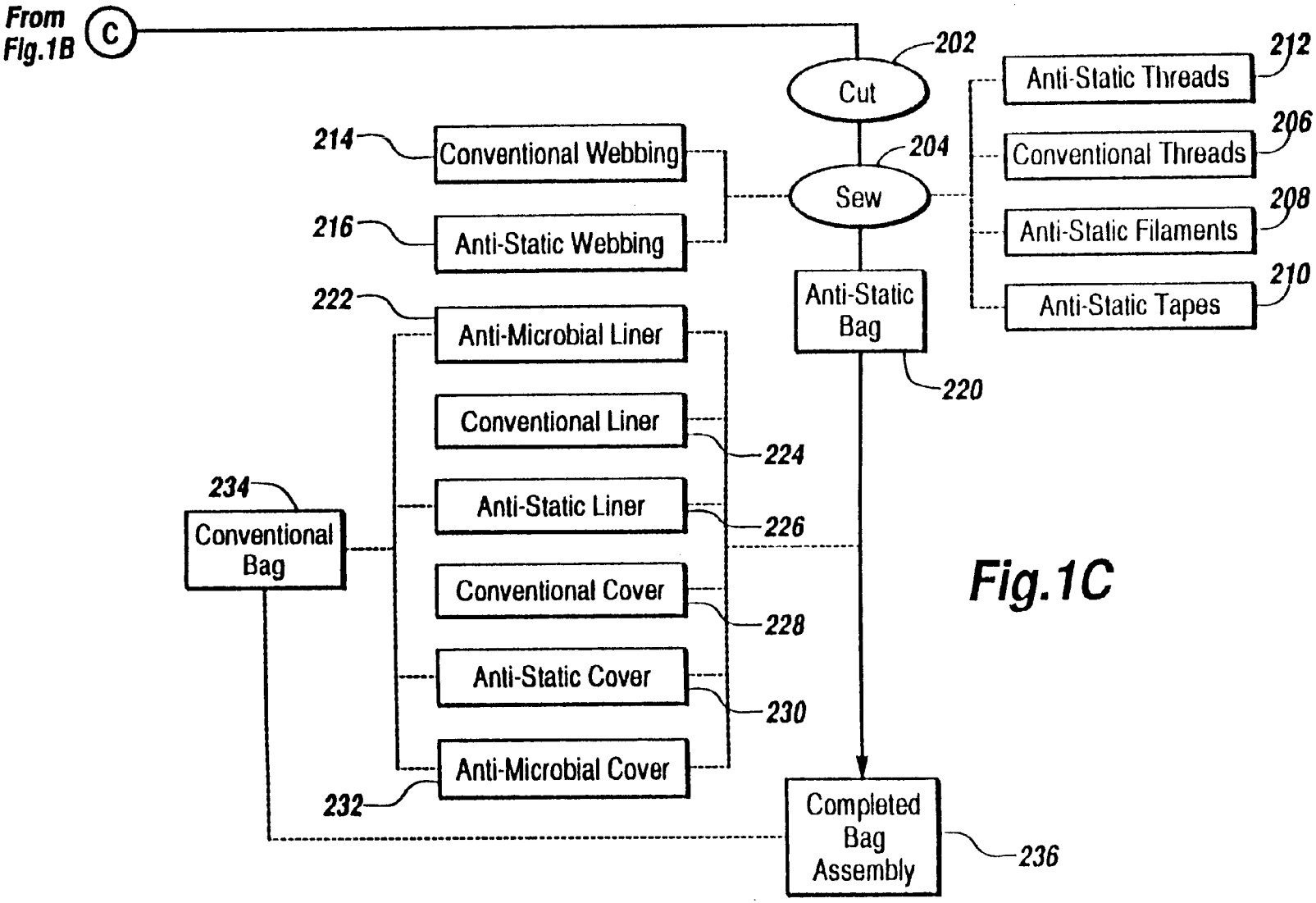

Referring now to the Drawings, FIGS. 1A, 1B, and 1C comprise a flow chart illustrating the use of the present invention in the manufacture of anti-static bulk bags. Referring particularly to boxes 21, 22, 23, and 24 of FIG. 1A, an anti-static material/thermoplastic resin mixture is blended with a thermoplastic resin to form an anti-static resin feedstock. The anti-static material/thermoplastic resin mixture of box 21 is preferably of the type distributed by Engineered Materials, Inc. of Buffalo Grove, Ill. Such material comprises a selected thermoplastic resin, typically polypropylene or polyethylene, and an inorganic anti-static material which is preferably of the type distributed by American Telephone and Telegraph Company (AT&T) under the trademark STATIC INTERCEPT®.

The inorganic anti-static material/thermoplastic resin mixture is blended with the thermoplastic resin of box 23 in conventional blending equipment. The particular thermoplastic resin which is selected for blending with the anti-static material/thermoplastic resin mixture of box 21 is preferably of the same general type as the resin comprising the anti-static material/thermoplastic resin mixture, and is selected in accordance with the desired melt temperature and the desired melt flow rate utilizing prior art techniques.

The anti-static material/thermoplastic resin mixture of box 21 and the thermoplastic resin of box 23 are blended to provide the anti-static resin feedstock of box 24 having a predetermined conductivity. Conductivity can be tailored within a range from about 10 to the 4th ohms per square to about 10 to the 12th ohms per square. Conductivities in the range of about 10 to the 4th ohms per square up to about 10 to the 8th per square are generally considered to be conductive. Bulk bags fabricated from anti-static materials in this range require grounding and are used in the handling of materials comprising gaseous, flammable atmospheres. Conductivities in the range of about 10 to the 8th ohms per square up to about 10 to the 12th ohms per square are generally considered to be dissipative or semi-conductive. Bulk bags manufactured from anti-static materials in this range are suitable for use with flammable powders which do not comprise a gaseous environment. Conductivities above about 10 to the 13th ohms per square are generally considered to be insulative, and therefore not suitable for the construction of anti-static bulk bags.

Referring to box 25 of FIG. 1A, the next step in the practice of the invention comprises the extrusion of the anti-static resin feedstock from box 24 to form any one of a variety of products. For example, as indicated in box 26, the extrusion step may be used to form an anti-static layer on an anti-static fabric, which may comprise either a prior art anti-static fabric or an anti-static fabric made in accordance with the present invention. Alternatively, the extrusion step may be used to form an anti-static layer on a conventional fabric as indicated at box 27, or to form an anti-static layer on an anti-corrosion fabric as indicated at box 28, or to form an anti-static layer on an anti-microbial fabric as indicated at box 29, or to form a layer of conventional polymeric material on an anti-static fabric. The extrusion step may also be used to form an anti-static layer on a conventional polymeric film as indicated at box 30, or to form an anti-static layer on an anti-corrosion film as indicated at box 32, or to form an anti-static layer on an anti-static film as indicated at box 34, or to form an anti-static layer on an anti-microbial film as indicated at box 36.

Figure 4:
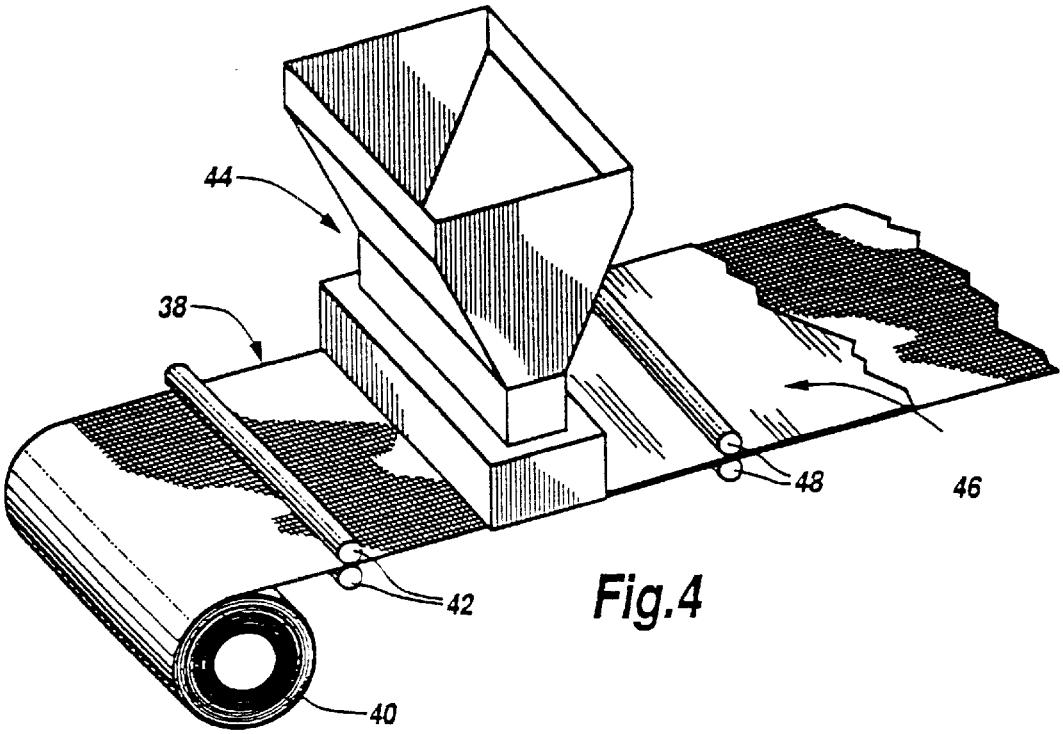
FIG. 4 is a diagrammatic illustration of an extruder.

The procedures of boxes 26, 27, 28, 29, 30, 32, 34, and 36 are further illustrated in FIG. 4. A length of material 38, which may comprise anti-static, anti-corrosion, anti-microbial or conventional fabric, or anti-static, anti-corrosion, anti-microbial, or conventional film is fed from a supply roll 40 by means of pinch rollers 42 or other conventional apparatus. The length of material 38 extends through an extruder 44 which extrudes a layer of anti-static material 46 onto the length of material 38. The thickness of the layer of anti-static material 46 on the length of the material 38 is controlled by the operation of the extruder 44 and by the operation of a pair of pinch rollers 48 or other conventional apparatus typically employed in extrusion processes.

Figure 5:
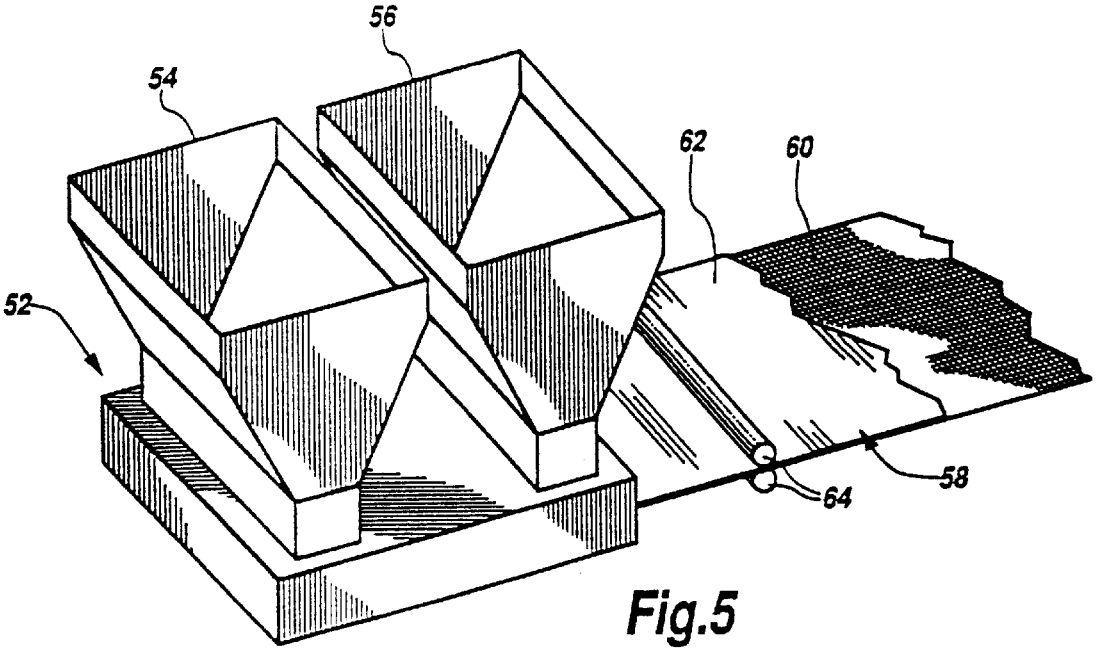
FIG. 5 is a diagrammatic illustration of a co-extruder.

An important aspect of the invention is indicated at boxes 49, 50, 51, and 52 of FIG. 1A and illustrated in FIG. 5. A conventional co-extrusion apparatus 53 comprises a hopper 54 which receives either an anti-static resin, or an anti-corrosion resin, or an anti-microbial resin, or a conventional thermoplastic resin and a hopper 56 which receives the anti-static resin feedstock of box 24 of FIG. 1A. The co-extrusion apparatus 53 is utilized to form a length of material 58 comprising either an anti-static layer, or an anti-corrosion layer, or an anti-microbial layer, or a conventional layer 60 and a co-extruded anti-static layer 62. The thickness of the length of material 58 and the layers 60 and 62 thereof is controlled by the operation of the co-extrusion apparatus 53 and by the operation of a pair of pinch rollers 64 and/or other conventional apparatus typically used in co-extrusion procedures. Typically, the anti-static layer 62 will be thinner than the layer 60 for purposes of economy.

Referring again to FIG. 1A, the extrusion step of box 25 may be utilized to form an anti-static film as indicated at box 66. The anti-static film of box 66 may be utilized directly in subsequent steps of the invention, or as indicated at box 68, the anti-static film may be used in the furtherance of lamination procedures also comprising an important aspect of the invention. Specifically, the anti-static film of box 66 may be laminated onto a conventional film as indicated at box 70, or onto an anti-static film as indicated at box 72, or onto an anti-microbial film as indicated at box 74, or onto an anti-corrosion film as indicated at box 75.

Figure 6:
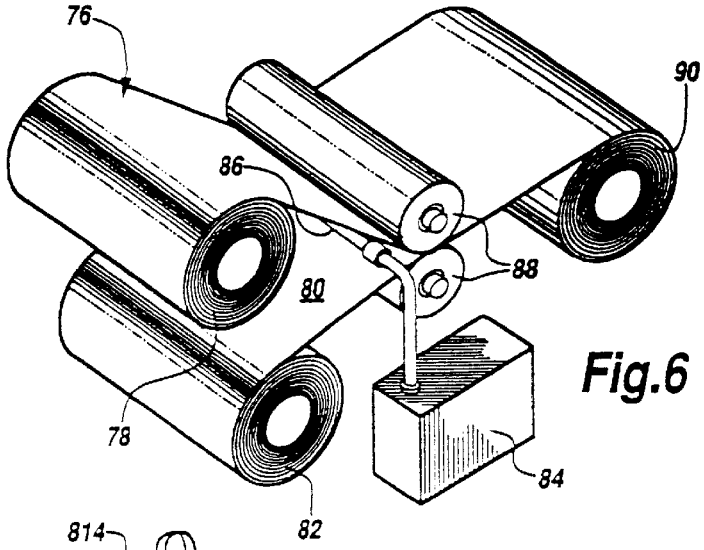
FIG. 6 is a diagrammatic illustration of a lamination apparatus and process.

The foregoing procedures are further illustrated in FIG. 6. A length of anti-static film 76 may be fed from a feed roll 78. A length of material 80, comprising either a conventional film, or an anti-static film, or an anti-microbial film, or an anti-corrosion film is fed from a supply roll 82. A reservoir 84 contains a supply of liquid adhesive, which is preferably a thermoplastic adhesive matched to the materials comprising the length of material 76 and the length of material 80. Liquid adhesive is fed from the reservoir 84 to a nozzle 86 located between the lengths of material 76 and 80 and used to apply liquid adhesive thereto. Immediately after the application of liquid adhesive thereto, the lengths of material 76 and 80 are fed between a pair of pinch rollers 88, whereby the length of material is securely bonded to the length of material 80 under the action of the liquid adhesive dispensed from the nozzle 86. The resulting laminate may be wound upon a take-up roll 90 or utilized directly.

Referring again to FIG. 1A, the extrusion step of box 25 may be used to form anti-static tapes as indicated at box 92. The anti-static tapes are not entirely unlike the anti-static film of box 66, but differ therefrom dimensionally. Whereas the anti-static film of box 66 is typically long and wide and characterized by a substantial thickness, the anti-static tapes of box 92 are typically relatively long, relatively narrow, relatively thin, and flat in cross section. The anti-static tapes of box 92 are dimensionally similar to the polymeric tapes which are conventionally supplied for use in weaving fabrics to be used in the manufacture of flexible, collapsible containers for flowable materials.

As indicated at box 94, the extrusion process of box 25 may also be used to manufacture anti-static filaments. The anti-static filaments of box 94 are similar to the anti-static tapes of box 92 in that they comprise weavable members which may be utilized in conventional weaving apparatus to manufacture fabrics which may in turn be used in the manufacture of flexible, collapsible bags for handling flowable materials. The anti-static filaments of box 94 differ from the anti-static tapes of box 92 in that, whereas the anti-static tapes are typically flat in cross section, the anti-static filaments of box 94 are typically round or oval in cross section and therefore resemble conventional threads. The anti-static tapes of box 92 and/or the anti-static filaments of box 94 may be twisted to form anti-static threads, if desired.

The anti-static tapes of box 92 may conveniently be thought of as extruded anti-static tapes comprising weavable members useful in conventional weaving apparatus to form an anti-static fabric. As indicated by box 96 of FIG. 1B, the anti-static layers extruded onto the various films of boxes 30, 32, 34, and 36; the anti-static layers co-extruded with the various layers of boxes 49, 50, 51, and 52; the anti-static film of box 66; and/or the anti-static films laminated onto the various films of boxes 70, 72, 74, and 75 may also be utilized to form anti-static tapes by means of conventional slitting apparatus. Like the anti-static tapes of box 92, the anti-static tapes formed in the slitting process of box 96 typically comprise a relatively long, relatively narrow, relatively thin configuration which is flat in cross section. The anti-static tapes manufactured by the slitting step of box 96 may be conveniently considered as slit anti-static tapes as compared with the extruded anti-static tapes of box 92.

Referring to box 100, the next step in the practice of the invention comprises weaving one or more of the weavable members formed in accordance with the present invention and comprising the slit anti-static tapes of box 98, the extruded anti-static tapes of box 92, the extruded anti-static filaments of box 94 and/or anti-static threads to manufacture an anti-static fabric. As is indicated at boxes 102, 104, and 105 conventional tapes, and/or conventional filaments and/or conventional threads formed from non-anti-static polymeric materials may be combined with the weavable anti-static members of the present invention to form an anti-static fabric, if desired. In such event, the weavable anti-static members of the present invention would typically comprise a reduced proportion of the total number of weavable members utilized in the weaving step of box 100 to form an anti-static fabric, and typically would be arranged in a grid pattern. Alternatively, the anti-static tapes and/or threads of the present invention may be twisted together with conventional tapes or filaments to form anti-static threads which may be used in the weaving step.

As indicated at boxes 106 and 107, the results of the weaving step of box 100 is either anti-static fabric or anti-static webbing. Depending on which of the procedures of the present invention is used to fabricate the weavable members which are used in the weaving step of box 100, the anti-static fabric of box 106 and/or the anti-static webbing of box 107 may be comprised either entirely of anti-static material, or of an anti-static material which is either extruded onto a polymeric fabric or film, co-extruded with a polymeric layer, or of an anti-static film that is laminated onto a polymeric film. Weavable members formed from conventional polymeric materials may be combined with weavable members formed in accordance with the present invention in carrying out the weaving step, if desired. In any event, the anti-static fabric of box 106 and the anti-static webbing of box 107 are characterized by a predetermined resistivity which is selected in accordance with the utilization that will ultimately be made of the anti-static fabric.

Referring to box 108, the anti-static materials of the present invention, whether singly, in combination with other anti-static materials of the present invention, or in combination with conventional tapes and/or filaments may be utilized in the knitting of anti-static fabric. The knitting step of box 108 is useful when the resulting fabric does not require dimensional stability. As indicated at box 109, the anti-static tapes and/or filaments of the present invention, either alone or in combination with conventional tapes, filaments, or threads may be braided to make the anti-static rope of box 110 or the anti-static thread of box 111.

Figures 7, 8:
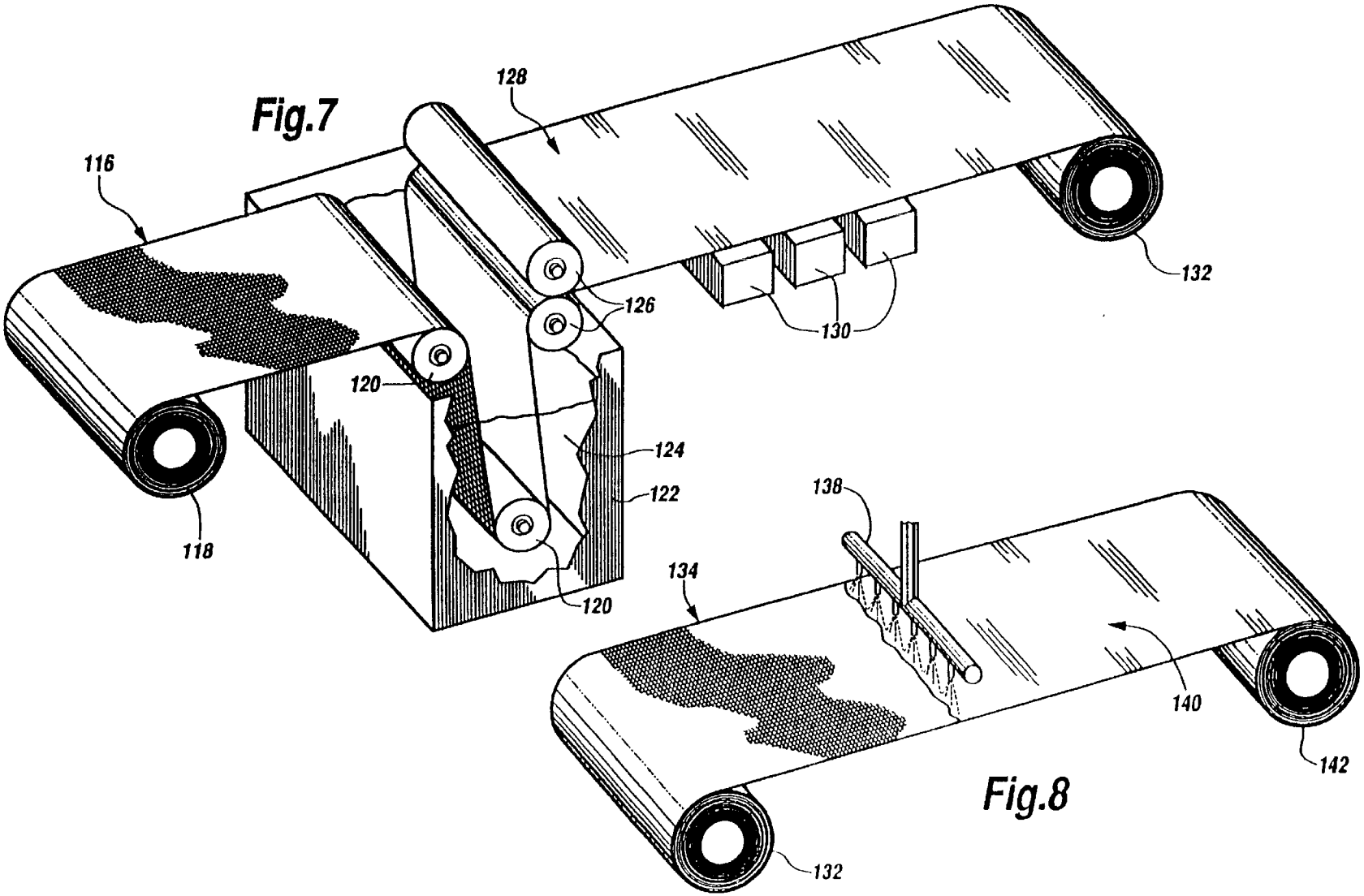
FIG. 7 is a diagrammatic illustration of a dip coating apparatus and process.
FIG. 8 is a diagrammatic illustration of a spray coating apparatus and process.

Referring now to FIG. 1B and particularly to box 112, the next step in the practice of the invention may optionally comprise the coating of the anti-static fabric of box 106 with an anti-static material to provide an anti-static coating on an anti-static fabric as indicated at box 114. The coating step of box 112 may be carried out utilizing various conventional procedures. Referring specifically to FIG. 7, a length of anti-static material 116 manufactured in accordance with the present invention is fed from a supply roll 118 and is directed over rollers 120 and through a vat 122 having a quantity of liquid anti-static material 124 contained therein. The length of material 116 then passes between a pair of pinch rollers 126 which function to remove excess liquid anti-static material from the length of material 116. The length of anti-static material 116 having the coating of anti-static material 128 coated thereon then passes adjacent a plurality of driers 130 which function to solidify the coating of anti-static material 128 on the length of anti-static material 116 which is then accumulated on a take-up roll 132 or utilized directly.

An alternative coating procedure is illustrated in FIG. 8. A length of anti-static material 134 is fed from a supply roll 136. The length of anti-static material 134 passes under a conventional spray head 138 which functions to deposit a coating of anti-static material 140 on the length of anti-static material 134. The coating dries in the atmosphere, and the length of anti-static material having the anti-static coating 140 formed thereon is then accumulated on a take-up roll 142 or utilized directly.

The coating procedures of FIGS. 7 and 8 are not limited to the application of anti-static material to anti-static fabric. As indicated at box 115, the procedures of FIGS. 7 and 8 and other conventional coating procedures can be used to apply the anti-static material of the present invention to conventional fabrics, or to apply either anti-microbial material or conventional polymeric material to anti-static fabrics.

An optional laminating step comprising the present invention is also illustrated in FIG. 1B at box 144. The laminating step may be carried out as described hereinabove in connection with FIG. 6, and may be used to laminate a conventional film onto an anti-static fabric as indicated at box 146 or to laminate an anti-microbial film onto an anti-static fabric as indicated at box 148, or to laminate an anti-static film onto an anti-static fabric as indicated at box 150 or to laminate an anti-corrosion film onto an anti-static fabric as indicated at box 151. If a film is laminated onto an anti-static fabric as indicated at boxes 146, 148, and 151, the film may be subjected to a conventional procedure for forming micropores therein as indicated at box 152, thereby providing access through the film to the anti-static fabric for the dissipation of static electricity.

The laminating step of box 144 may also be utilized to laminate an anti-static film onto a conventional fabric, as shown at box 154. The anti-static film may be manufactured in accordance with the invention by the extrusion process of box 25 of FIG. 1A to provide the anti-static film of box 66. The laminating process may be carried out in accordance with the procedure described in accordance with FIG. 6.

Figure 9A:
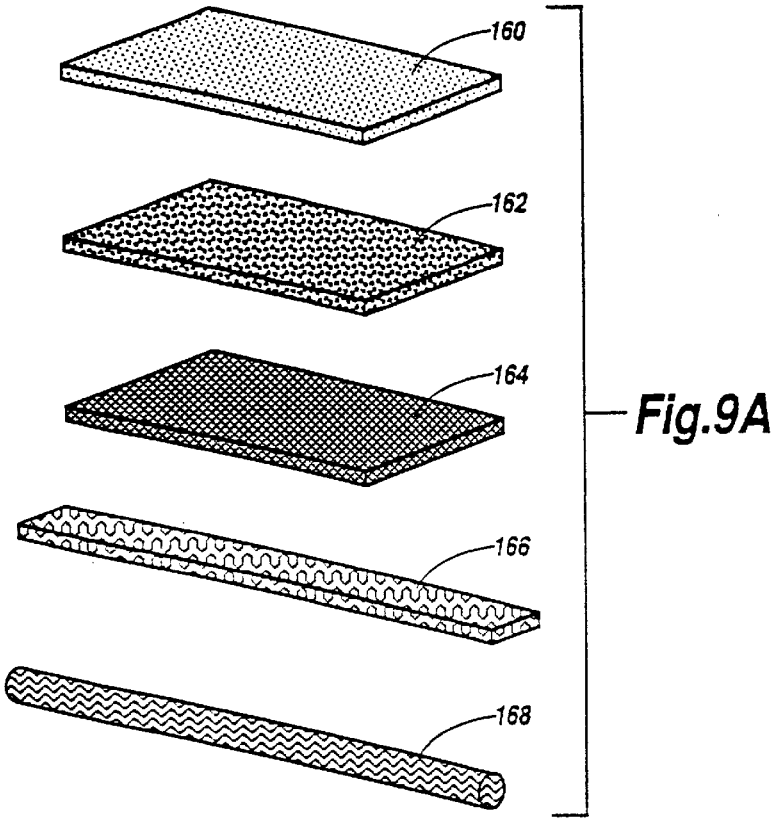
FIGS. 9A, 9B, 9C, and 9D comprise a key useful in interpreting FIGS. 10A–10Q and FIGS. 11A–11J.
Figure 9B:
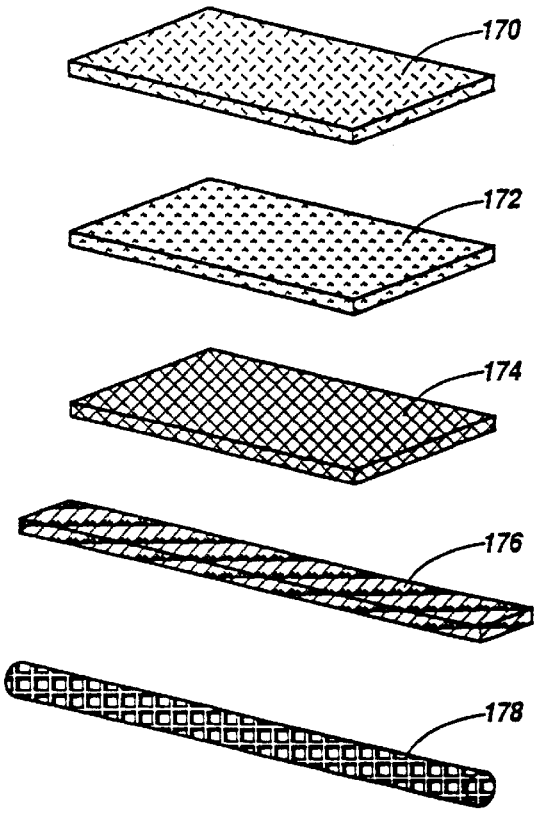
Figure 9C:
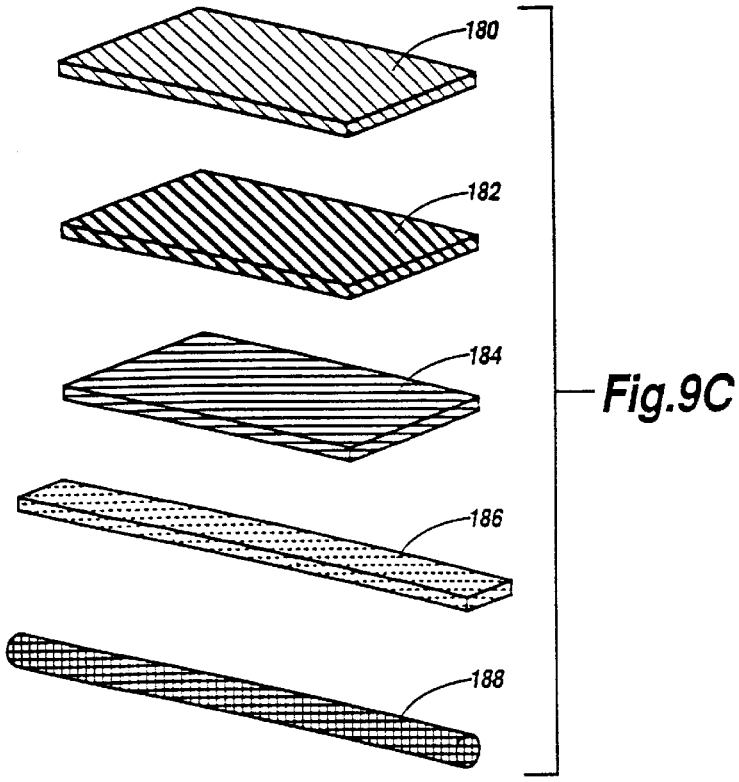
Figure 9D:
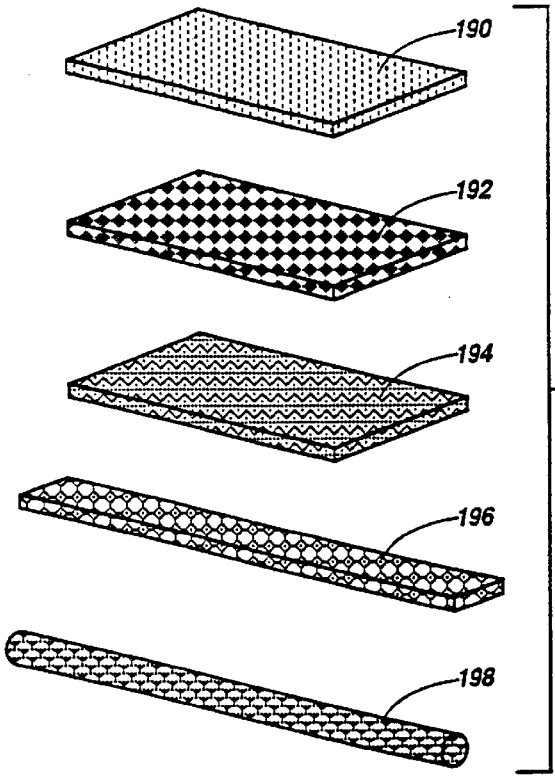
Figure 10A:
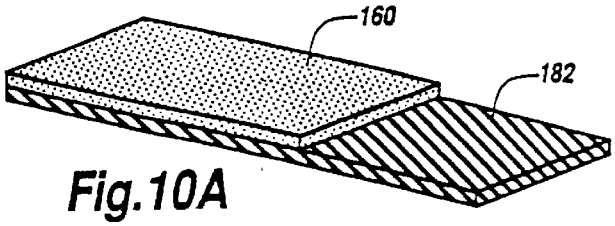
FIG. 10A is a perspective view of an anti-static layer extruded onto an anti-microbial fabric.
Figure 10B:
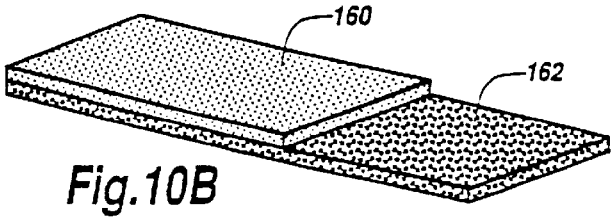
FIG. 10B is a perspective view of an anti-static layer extruded onto an anti-static fabric.
Figure 10C:
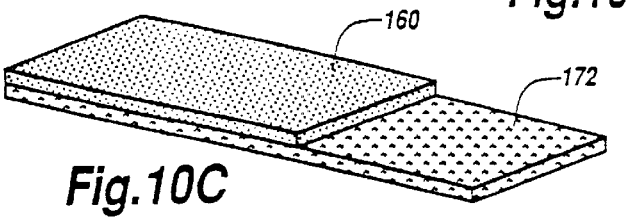
FIG. 10C is a perspective view of an anti-static layer extruded onto an anti-corrosion fabric.
Figure 10D:
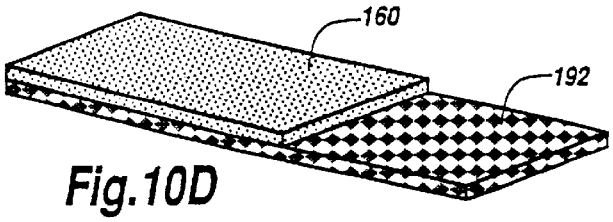
FIG. 10D is a perspective view of an anti-static layer extruded onto a conventional fabric.
Figure 10E:
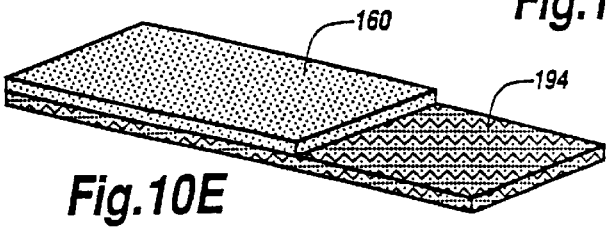
FIG. 10E is a perspective view of an anti-static layer extruded onto a conventional film.
Figure 10F:
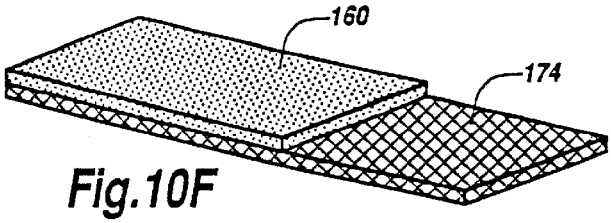
FIG. 10F is a perspective view of an anti-static layer extruded onto an anti-corrosion film.
Figure 10G:
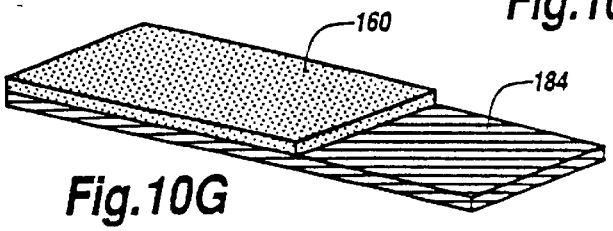
FIG. 10G is a perspective view of an anti-static layer extruded onto an anti-microbial film.
Figure 10H:
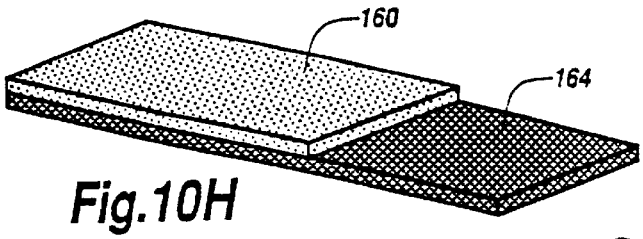
FIG. 10H is a perspective view of an anti-static layer extruded onto an anti-static film.

The results of the foregoing steps comprising the present invention are illustrated in FIGS. 9A through 9D, inclusive; FIGS. 10A through 10Q, inclusive; and FIGS. 11A through 11J, inclusive. Referring first to FIG. 9A, there is shown an anti-static layer 160, an anti-static fabric 162, an anti-static film 164, an anti-static tape 166, and an anti-static filament 168. In FIG. 9B there is shown an anti-corrosion layer 170, an anti-corrosion fabric 172, an anti-corrosion film 174, an anti-corrosion tape 176, and an anti-corrosion filament 178. FIG. 9C illustrates an anti-microbial layer 180, an anti-microbial fabric 182, an anti-microbial film 184, an anti-microbial tape 186, and an anti-microbial filament 188. In FIG. 9D there is shown a conventional layer 190, a conventional fabric 192, a conventional film 194, a conventional tape 196, and a conventional filament 198.

FIG. 10A comprises a perspective view of an anti-static layer 160 extruded onto an anti-microbial fabric 182 as indicated at box 29 of FIG. 1A. FIG. 10B is a perspective view of an anti-static layer 160 extruded onto an anti-static fabric 162 as indicated at box 26. FIG. 10C is a perspective view of an anti-static layer 160 extruded onto an anti-corrosion fabric 172 as indicated at box 28. FIG. 10D is a perspective view of an anti-static layer 160 extruded onto a conventional fabric 192 as indicated at box 27. FIG. 10E is a perspective view of an anti-static layer 160 extruded onto a conventional film 194 as indicated at box 30. FIG. 10F is a perspective view of an anti-static layer extruded onto an anti-corrosion film 174 as indicated at box 32. FIG. 10G is a perspective view of an anti-static layer extruded onto an anti-microbial film 184 as indicated at box 36. FIG. 10H is a perspective view of an anti-static layer 160 extruded onto an anti-static film 164 as indicated at box 34.

Figure 10J:
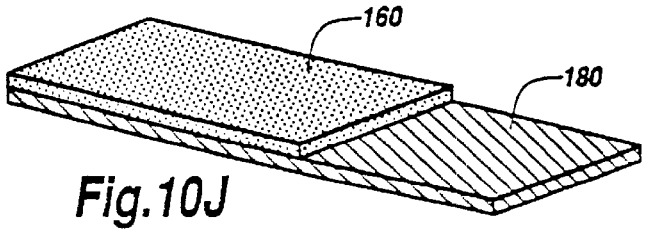
FIG. 10J is a perspective view of a co-extrusion comprising a layer of anti-static material and a layer of anti-microbial material.
Figure 10K:
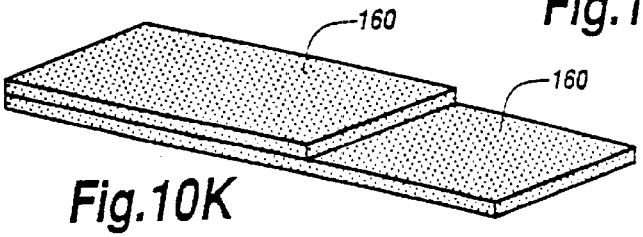
FIG. 10K is a perspective view of a co-extrusion comprising a layer of anti-static material and a layer of anti-static material.
Figure 10L:
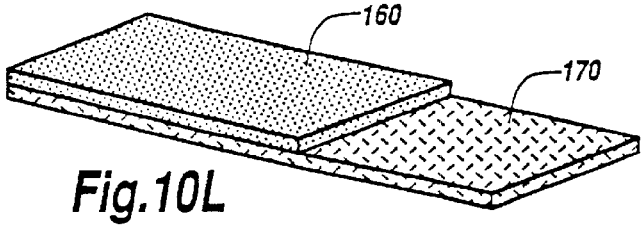
FIG. 10L is a perspective view of a co-extrusion comprising a layer of anti-static material and a layer of anti-corrosion material.
Figure 10M:
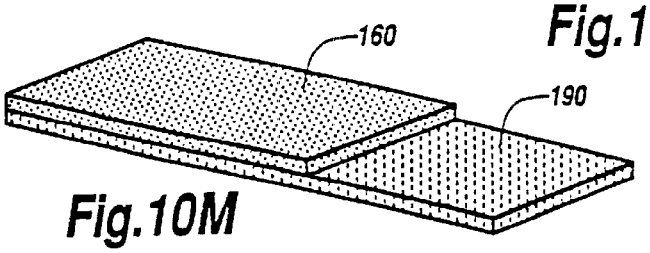
FIG. 10M is a perspective view of a co-extrusion comprising a layer of anti-static material and a layer of conventional polymeric material.
Figure 10N:
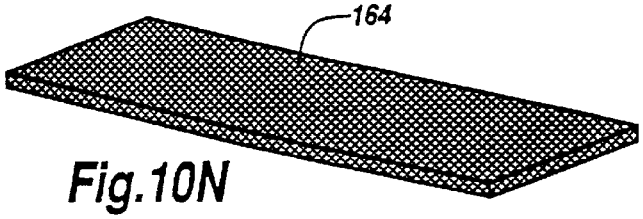
FIG. 10N is a perspective view of an extruded anti-static film.
Figure 10P:
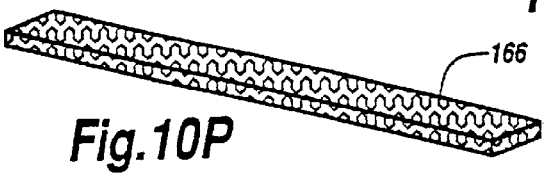
FIG. 10P is a perspective view of an extruded anti-static tape.
Figure 10Q:
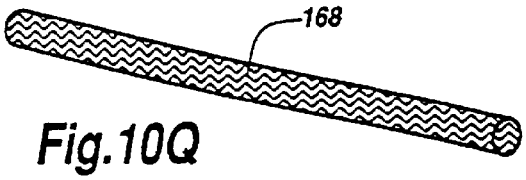
FIG. 10Q is a perspective view of an extruded anti-static filament.

FIG. 10J is a perspective view of an anti-static layer 160 co-extruded with an anti-microbial layer 180 as indicated at box 51. FIG. 10K is a perspective view of an anti-static layer 160 co-extruded with an anti-static layer 160 as indicated at box 52. FIG. 10L is a perspective view of an anti-static layer co-extruded with an anti-corrosion layer as indicated at box 50. FIG. 10M is a perspective view of an anti-static layer 160 co-extruded with a conventional layer 190 as indicated at box 49. FIG. 10N is a perspective view of an anti-static film 164 as indicated at box 66. FIG. 10P is perspective view of an anti-static tape 166 as indicated at box 92. FIG. 10Q is a perspective view of an anti-static filament 168 as indicated at box 94.

Figures 11A, 11B, 11C, 11D, 11E, 11F, 11G, 11H, 11J:
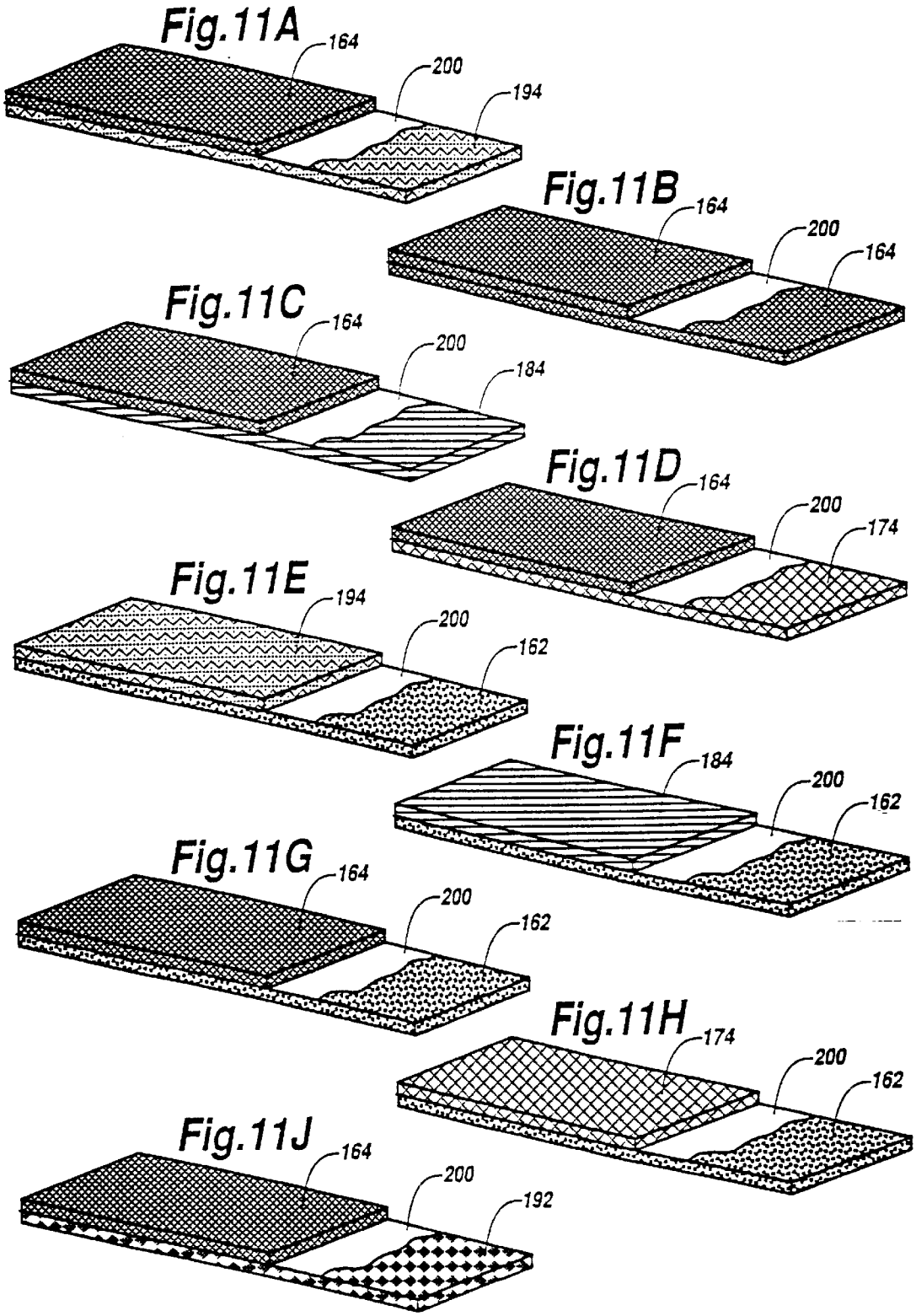
FIG. 11A is a perspective view of an anti-static film laminated onto a conventional film.
FIG. 11B is a perspective view of an anti-static film laminated onto an anti-static film.
FIG. 11C is a perspective view of an anti-static film laminated onto an anti-microbial film.
FIG. 11D is a perspective view of an anti-static film laminated onto an anti-corrosion film.
FIG. 11E is a perspective view of a conventional polymeric film laminated onto an anti-static fabric.
FIG. 11F is a perspective view of an anti-microbial film laminated onto an anti-static fabric.
FIG. 11G is a perspective view of an anti-static film laminated onto an anti-static fabric.
FIG. 11H is a perspective view of an anti-corrosion film laminated onto an anti-static fabric.
FIG. 11J is a perspective view of an anti-static film laminated onto a conventional film.

FIG. 11A is a perspective view of an anti-static film 164 laminated to a conventional film 194 by means of a layer of thermo-plastic adhesive 200 as indicated at box 70. FIG. 11B is a perspective view of an anti-static film 164 laminated to an anti-static film 164 by means of a layer of thermo-plastic adhesive 200 as indicated at box 72. FIG. 11C is a perspective view of an anti-static film 164 laminated to an anti-microbial film 184 by means of a layer of thermo-plastic adhesive 200 as indicated at box 74. FIG. 11D is a perspective view of an anti-static film 164 laminated to an anti-corrosion film 174 by means of a layer of thermo-plastic film 200 as indicated at box 75.

FIG. 11E is a perspective view of a conventional film 194 laminated to an anti-static fabric 162 by means of a layer of thermo-plastic adhesive 200 as indicated at box 146 of FIG. 1B. FIG. 11F is a perspective view of an anti-microbial film 184 laminated to an anti-static fabric 162 by means of a layer of thermo-plastic adhesive 200 as indicated at box 148. FIG. 11G is a perspective view of an anti-static film 164 laminated to an anti-static fabric 162 by means of a layer of thermo-plastic adhesive 200 as indicated at box 150. FIG. 11H is a perspective view of an anti-corrosion film laminated to an anti-static fabric 162 by means of a layer of thermo-plastic adhesive 200 as indicated at box 151. FIG. 11J is a perspective view of an anti-static film laminated to a conventional fabric by means of a layer of thermo-plastic adhesive 200 as indicated at box 154.

As indicated at box 202 of FIG. 1C, the next step in the practice of the present invention comprises the cutting of the anti-static fabric in accordance with a predetermined pattern to provide the pieces necessary to fabricate an anti-static bulk bag. The cutting step of box 202 may be utilized in conjunction with the anti-static fabric of box 106; or with the fabrics comprising an anti-static layer extruded onto a fabric of boxes 26, 27, 28, or 29; or with a fabric having an anti-static coating thereon as depicted in boxes 114 and 115; or with a fabric having a film laminated thereon which may have been provided with micropores as indicated at boxes 146, 148, 150, 151, and 152. In any event, the anti-static fabric is cut utilizing conventional fabric cutting apparatus and in accordance with a predetermined pattern to provide the pieces necessary to fabricate the desired bulk bag configuration.

The next step in the practice of the present invention comprises the sewing step of box 204. The sewing step of box 204 incorporates a variety of options. For example, the sewing step of the present invention may be carried out utilizing conventional threads as indicated at box 206. Alternatively, the sewing step may be carried out utilizing anti-static filaments as indicated at box 208. The anti-static filaments of box 208 may be fabricated in accordance with the present invention as indicated at box 94, or utilizing conventional techniques. Still another alternative is the utilization of anti-static tapes in the sewing step of box 204 as indicated at box 210. Like the anti-static filaments of box 208, the anti-static tapes may be fabricated in accordance with the present invention either as indicated at box 92 or as indicated at box 98, or the anti-static tapes of box 210 may be fabricated utilizing conventional techniques. Anti-static threads may also be used as indicated at box 212.

A further option in the furtherance of the sewing step illustrated at box 204 is the selection of the webbing to be used in the construction of anti-static bulk bags incorporating the present invention. As indicated at box 214, conventional webbing may be utilized in the practice of the invention. Alternatively, anti-static webbing may be utilized in the practice of the invention as indicated at box 216. If anti-static webbing is employed in the sewing step of box 204, the selected anti-static webbing may be manufactured either in accordance with the present invention or in accordance with prior art techniques.

As indicated at box 220, the completion of the sewing step of box 204 results in the construction of the completed anti-static bulk bag. In most instances the anti-static bag resulting from the completion of the sewing step of box 204 will be utilized as is. That is, no liner, cover, or other accessory will be needed in order to provide an anti-static bag which fully complies with the requirements of a particular utilization of the invention. However, in some instances it may be considered desirable to provide the anti-static bag of box 190 with a liner and/or with a cover.

As indicated at box 222, the anti-static bag of box 220 may be provided with an anti-microbial liner manufactured in accordance with the present invention. As indicated at box 224, the anti-static bag of box 220 may be provided with a conventional liner, which typically will comprise a length of thermoplastic material extruded in the form of a tube having a diameter matched to the interior dimensions of the anti-static bag in which it will be used. As indicated at box 226, the anti-static bag of box 190 may be provided with an anti-static liner comprising a length of anti-static material extruded pursuant to the extruding step of box 25 of FIG. 1A in the form of a tube having a diameter matched to the interior directions of the anti-static bulk bag in which it will be used.

As indicated at box 228, the anti-static bulk bag of box 190 may be provided with a conventional cover. Such a device would comprise the length of conventional thermo-plastic film cut into a plurality of pieces in accordance with a predetermined pattern. The pieces would then be joined by conventional techniques, such as heat sealing to provide a bag cover having interior dimensions matched to the exterior dimensions of the anti-static bulk bag of box 220. As indicated at box 230, the anti-static bag of box 220 may also be provided with an anti-static cover manufactured similar to the conventional cover of box 228, but fabricated from a length of anti-static film fabricated in accordance with the present invention as indicated at box 66. Lastly, as indicated at box 232 the anti-static bag of box 220 may be provided with an anti-microbial cover fabricated similarly to the conventional cover of box 228 but formed from an anti-microbial material manufactured in accordance with the present invention.

As indicated at box 234, certain aspects of the present invention are applicable to conventional bags manufactured from conventional materials in accordance with conventional techniques. As indicated by box 222, such a conventional bag may be provided with an anti-microbial liner manufactured in accordance with the present invention. As indicated by box 226, conventional bags may be provided with anti-static liners manufactured in accordance with the present invention. As indicated by box 230, conventional bags may be provided with anti-static covers manufactured in accordance with the present invention. As indicated by box 232, conventional bags may be provided with anti-microbial covers manufactured in accordance with the present invention.

Box 236 of FIG. 1C indicates a completed bulk bag assembly. Such a completed bag assembly may comprise the anti-static bulk bag of box 220 provided with a liner which is either anti-microbial, conventional, or anti-static in nature. Alternatively, the completed bulk bag assembly may comprise the anti-static bulk bag of box 220 provided with a cover which is either conventional, or anti-static, or anti-microbial in nature. As a further alternative, the completed bulk bag assembly of box 236 may comprise the conventional bulk bag of box 234 provided with either an anti-microbial or an anti-static liner, or provided with either an anti-static cover or an anti-microbial cover. It will understood, however, that in most instances the anti-static bag of box 190 will not require any accessories and will comprise the completed bag assembly in and of itself.

Figure 2A:
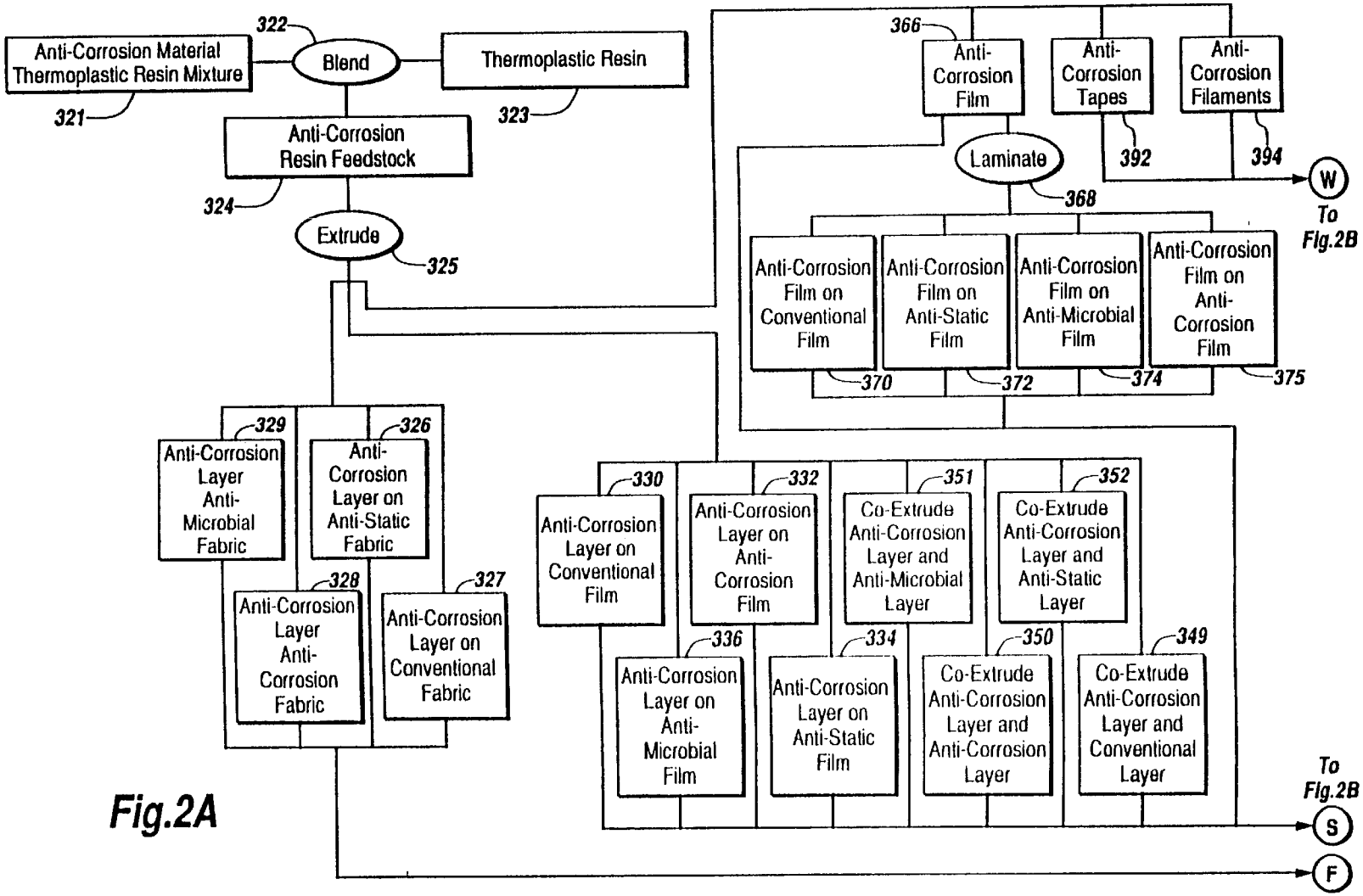
FIGS. 2A, 2B, and 2C comprise a flow chart illustrating numerous alternative methods for producing fabrics, fabric bags, bag liners and bag covers incorporating improved corrosion inhibition.
Figure 2B:
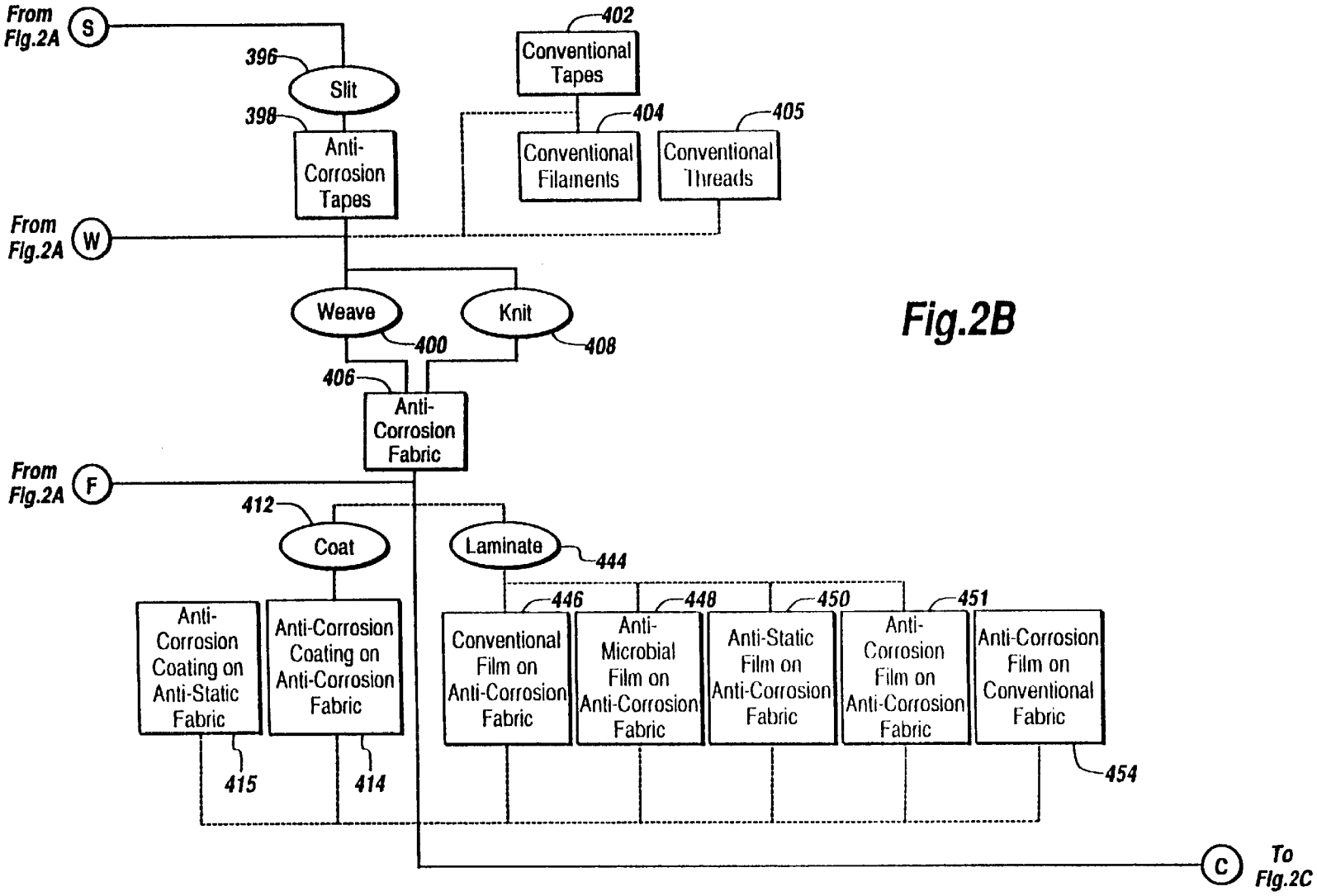
Figure 2C:
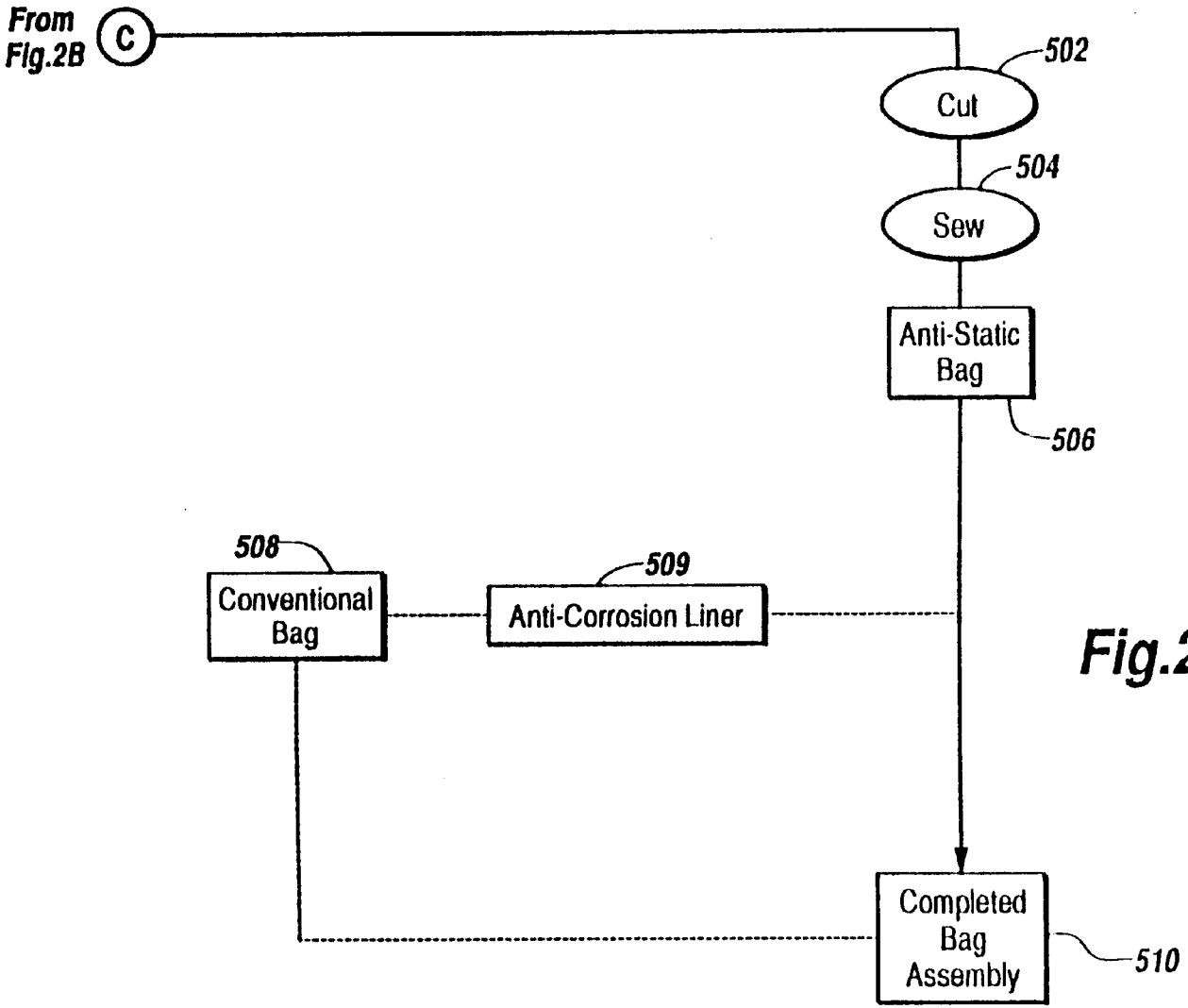

FIGS. 2A, 2B, and 2C comprise a flow chart illustrating the use of the present invention in the manufacture of anti-corrosion bulk bags. Referring particularly to boxes 321, 322, 323, and 324 of FIG. 2A, an anti-corrosion material/thermoplastic resin mixture is blended with a thermoplastic resin to form an anti-corrosion resin feedstock. The anti-corrosion material/thermoplastic resin mixture of box 321 is preferably of the type distributed by Engineered Materials, Inc. of Buffalo Grove, Ill. Such material comprises a selected thermoplastic resin, typically polypropylene or polyethylene, and an inorganic anti-corrosion material which is preferably of the type distributed by American Telephone and Telegraph Company (AT&T) under the trademark CORROSION INTERCEPT®.

The inorganic anti-corrosion material/thermoplastic resin mixture is blended with the thermoplastic resin of box 323 in conventional blending equipment. The particular thermoplastic resin which is selected for blending with the anti-corrosion material/thermoplastic resin mixture of box 321 is preferably of the same general type as the resin comprising the anti-corrosion material/thermoplastic resin mixture, and is selected in accordance with the desired melt temperature and the desired melt flow rate utilizing prior art techniques.

The anti-corrosion material/thermoplastic resin mixture of box 321 and the thermoplastic resin of box 323 are blended to provide the anti-corrosion resin feedstock of box 324 having predetermined anti-corrosion properties. Referring to box 325, the next step in the practice of the present invention comprises the extrusion of the anti-corrosion resin feedstock from box 324 to form any one of a variety of intermediate products.

For example, as indicated in box 326, the extrusion step may be used to form an anti-static layer on an anti-corrosion fabric, which may comprise either a prior art anti-static fabric or an anti-static fabric made in accordance with the present invention. Alternatively, the extrusion step may be used to form an anti-corrosion layer on a conventional fabric as indicated at box 327, or to form an anti-corrosion layer on an anti-corrosion fabric as indicated at box 328, or to form an anti-corrosion layer on an anti-microbial fabric as indicated at box 329, or to form a layer of conventional polymeric material on an anti-corrosion fabric. The extrusion step may also be used to form an anti-corrosion layer on a conventional polymeric film as indicated at box 330, or to form an anti-corrosion layer on an anti-corrosion film as indicated at box 332, or to form an anti-corrosion layer on an anti-static film as indicated at box 334, or to form an anti-corrosion layer on an anti-microbial film as indicated at box 336. The procedures of boxes 326, 327, 328, 329, 330, 332, 334, and 336 are carried out as illustrated in FIG. 4 and as described hereinabove in connection therewith.

An important aspect of the invention is indicated at boxes 349, 350, 351, and 352 of FIG. 2A and illustrated in FIG. 5. As indicated the anti-corrosion resin feedstock of box 324 may be co-extruded with an anti-static layer, or an anti-microbial layer, or with another anti-corrosion layer, or with a conventional polymeric layer.

The extrusion step of box 325 may be utilized to form an anti-corrosion film as indicated at box 366. The anti-corrosion film of box 366 may be utilized directly in subsequent steps of the invention, or as indicated at box 368, the anti-corrosion film may be used in the furtherance of lamination procedures also comprising an important aspect of the invention. Specifically, the anti-corrosion film of box 366 may be laminated onto a conventional film as indicated at box 370, or onto an anti-static film as indicated at box 372, or onto an anti-microbial film as indicated at box 374, or onto an anti-corrosion film as indicated at box 375. The foregoing procedures are further illustrated in FIG. 6.

Referring again to FIG. 2A, the extrusion step of box 325 may be used to form anti-corrosion tapes as indicated at box 392. The anti-corrosion tapes are not entirely unlike the anti-corrosion film of box 366, but differ therefrom dimensionally. Whereas the anti-corrosion film of box 366 is typically long and wide and characterized by a substantial thickness, the anti-corrosion tapes of box 392 are typically relatively long, relatively narrow, relatively thin, and flat in cross section. The anti-corrosion tapes of box 392 are dimensionally similar to the polymeric tapes which are conventionally supplied for use in weaving fabrics to be used in the manufacture of flexible, collapsible containers for flowable materials.

As indicated at box 394, the extrusion process of box 325 may also be used to manufacture anti-corrosion filaments. The anti-corrosion filaments of box 394 are similar to the anti-corrosion tapes of box 392 in that they comprise weavable members which may be utilized in conventional weaving apparatus to manufacture fabrics which may in turn be used in the manufacture of flexible, collapsible bags for handling flowable materials. The anti-corrosion filaments of box 394 differ from the anti-corrosion tapes of box 392 in that, whereas the anti-corrosion tapes are typically flat in cross section, the anti-corrosion filaments of box 394 are typically round or oval in cross section and therefore resemble conventional threads. The anti-corrosion tapes of box 392 and/or the anti-corrosion filaments of box 394 may be twisted to form anti-corrosion threads, if desired.

The anti-corrosion tapes of box 392 may conveniently be thought of as extruded anti-corrosion tapes comprising weavable members useful in conventional weaving apparatus to form an anti-corrosion fabric. As indicated by box 396 of FIG. 2B, the anti-corrosion layers extruded onto the various films of boxes 330, 332, 334, and 336; the anti-corrosion layers co-extruded with the various layers of boxes 349, 350, 351, and 352; the anti-corrosion film of box 366; and/or the anti-corrosion films laminated onto the various films of boxes 370, 372, 374, and 375 may also be utilized to form anti-corrosion tapes by means of conventional slitting apparatus. Like the anti-corrosion tapes of box 392, the anti-corrosion tapes formed in the slitting process of box 396 typically comprise a relatively long, relatively narrow, relatively thin configuration which is flat in cross section. The anti-corrosion tapes manufactured by the slitting step of box 396 may be conveniently considered as slit anti-corrosion tapes as compared with the extruded anti-corrosion tapes of box 392.

Referring to box 400, the next step in the practice of the invention comprises weaving one or more of the weavable members formed in accordance with the present invention and comprising the slit anti-corrosion tapes of box 398, the extruded anti-corrosion tapes of box 392, the extruded anti-corrosion filaments of box 94 and/or anti-corrosion threads to manufacture an anti-corrosion fabric. As is indicated at boxes 402, 404, and 405 conventional tapes, and/or conventional filaments and/or conventional threads formed from non-anti-corrosion polymeric materials may be combined with the weavable anti-corrosion members of the present invention to form an anti-corrosion fabric, if desired. In such event, the weavable anti-corrosion members of the present invention would typically comprise a reduced proportion of the total number of weavable members utilized in the weaving step of box 400 to form an anti-corrosion fabric, and typically would be arranged in a grid pattern. Alternatively, the anti-corrosion tapes and/or threads of the present invention may be twisted together with conventional tapes or filaments to form anti-corrosion threads which may be used in the weaving step.

Referring to box 408, the anti-corrosion materials of the present invention, whether singly, in combination with other anti-corrosion materials of the present invention, or in combination with conventional tapes and/or filaments may be utilized in the knitting of anti-corrosion fabric. The knitting step of box 408 is useful when the resulting fabric does not require dimensional stability.

Referring now to FIG. 2B and particularly to box 412, the next step in the practice of the invention may optionally comprise the coating of the anti-corrosion fabric of box 406 with an anti-corrosion material to provide an anti-corrosion coating on an anti-corrosion fabric as indicated at box 414. The coating step of 412 may be carried out utilizing various conventional procedures, such as those shown in FIGS. 7 and 8. The same procedures may be used to form an anti-corrosion coating on an anti-static fabric as indicated at box 415, or to form an anti-static coating, or an anti-microbial coating, or a coating of conventional polymeric material on an anti-corrosion fabric or to form an anti-corrosion layer on a conventional polymeric fabric.

An optional laminating step comprising the present invention is also illustrated in FIG. 2B at box 444. The laminating step may be carried out as described hereinabove in connection with FIG. 6, and may be used to laminate a conventional film onto an anti-corrosion fabric as indicated at box 446 or to laminate an anti-microbial film onto an anti-corrosion fabric as indicated at box 448, or to laminate an anti-static film onto an anti-corrosion fabric as indicated at box 450 or to laminate an anti-corrosion film onto an anti-corrosion fabric as indicated at box 451.

The laminating step of box 444 may also be utilized to laminate an anti-corrosion film onto a conventional fabric, as shown at box 454. The anti-corrosion film may be manufactured in accordance with the invention by the extrusion process of box 325 of FIG. 2A to provide the anti-corrosion film of box 366. The laminating process may be carried out in accordance with the procedure described in accordance with FIG. 6.

Figure 17A:
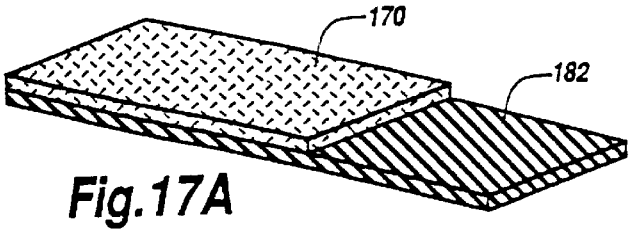
FIG. 17A is a perspective view of an anti-corrosion layer extruded onto an anti-microbial fabric.
Figure 17B:
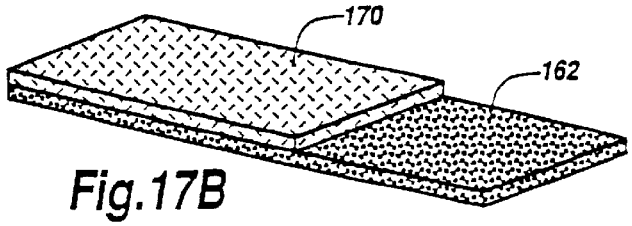
FIG. 17B is a perspective view of an anti-corrosion layer extruded onto an anti-static fabric.
Figure 17C:
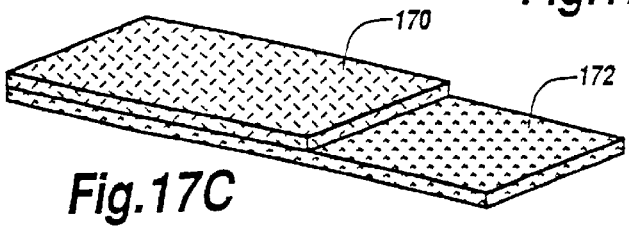
FIG. 17C is a perspective view of an anti-corrosion layer extruded onto an anti-corrosion fabric.
Figure 17D:
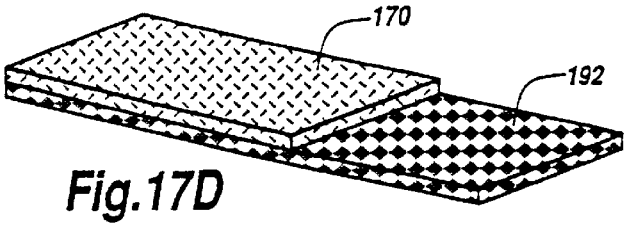
FIG. 17D is a perspective view of an anti-corrosion layer extruded onto a conventional fabric.

The results of the foregoing steps comprising the present invention are illustrated in FIGS. 9A through 9D, inclusive; FIGS. 17A through 17Q, inclusive; and FIGS. 18A through 18J, inclusive. Referring first to FIG. 9A, there is shown an anti-static layer 160, an anti-static fabric 162, an anti-static film 164, an anti-static tape 166, and an anti-static filament 168. In FIG. 9B there is shown an anti-corrosion layer 170, an anti-corrosion fabric 172, an anti-corrosion film 174, an anti-corrosion tape 176, and an anti-corrosion filament 178. FIG. 9C illustrates an anti-microbial layer 180, an anti-microbial fabric 182, an anti-microbial film 184, an anti-microbial tape 186, and an anti-microbial filament 188. In FIG. 9D there is shown a conventional layer 190, a conventional fabric 192, a conventional film 194, a conventional tape 196, and a conventional filament 198.

FIG. 17A comprises a perspective view of an anti-corrosion layer 170 extruded onto an anti-microbial fabric 182 as indicated at box 329 of FIGURE A. FIG. 17B is a perspective view of an anti-corrosion layer 170 extruded onto an anti-static fabric 162 as indicated at box 326. FIG. 17C is a perspective view of an anti-corrosion layer 170 extruded onto an anti-corrosion fabric 172 as indicated at box 328. FIG. 17D is a perspective view of an anti-corrosion layer 170 extruded onto a conventional fabric 192 as indicated at box 327.

Figure 17E:
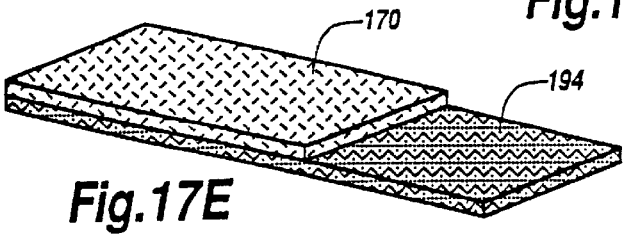
FIG. 17E is a perspective view of an anti-corrosion layer extruded onto a conventional film.
Figure 17F:
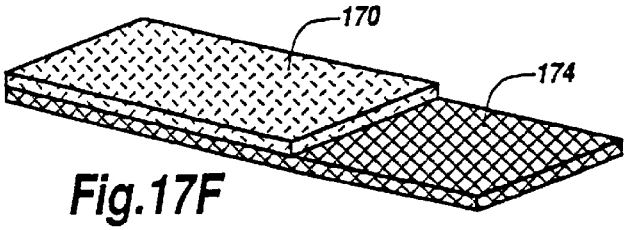
FIG. 17F is a perspective view of an anti-corrosion layer extruded onto an anti-corrosion film.
Figure 17G:
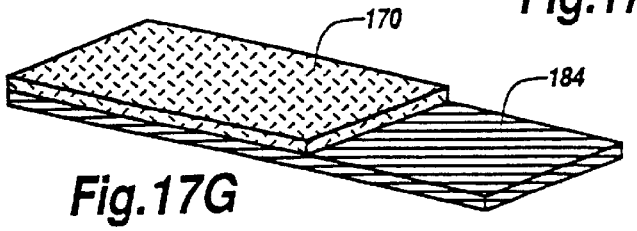
FIG. 17G is a perspective view of an anti-corrosion layer extruded onto an anti-microbial film.
Figure 17H:
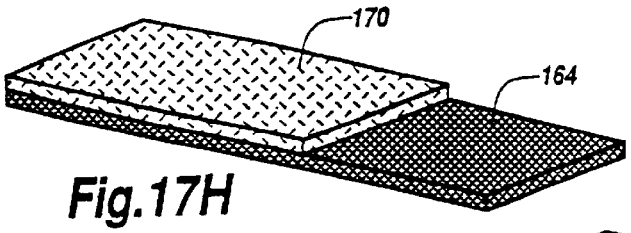
FIG. 17H is a perspective view of an anti-corrosion layer extruded onto an anti-static film.

FIG. 17E is a perspective view of an anti-corrosion layer 170 extruded onto a conventional film 194 as indicated at box 330. FIG. 17G is a perspective view of an anti-corrosion layer 170 extruded onto an anti-corrosion film 174 as indicated at box 332. FIG. 17G is a perspective view of an anti-corrosion layer 170 extruded onto an anti-microbial film 184 as indicated at box 336. FIG. 17H is a perspective view of an anti-corrosion layer 170 extruded onto an anti-static film 164 as indicated at box 334.

Figure 17J:
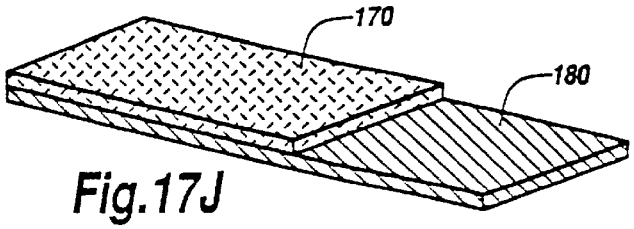
FIG. 17J is a perspective view of a co-extrusion comprising a layer of anti-corrosion material and a layer of anti-microbial material.
Figure 17K:
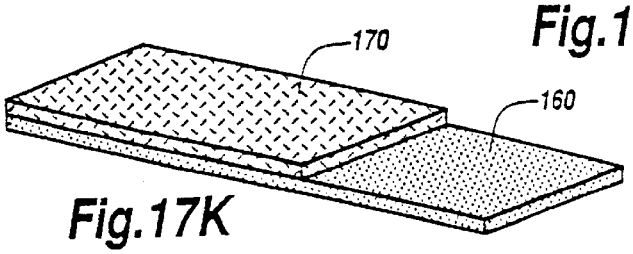
FIG. 17K is a perspective view of a co-extrusion comprising a layer of anti-corrosion material and a layer of anti-static material.
Figure 17L:
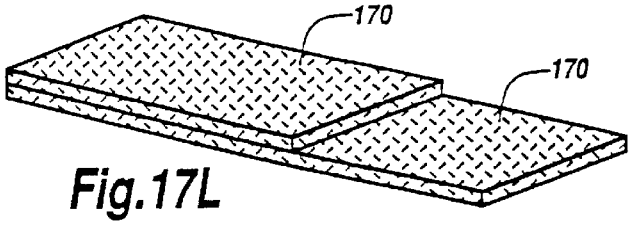
FIG. 17L is a perspective view of a co-extrusion comprising a layer of anti-corrosion material and a layer of anti-corrosion material.
Figure 17M:
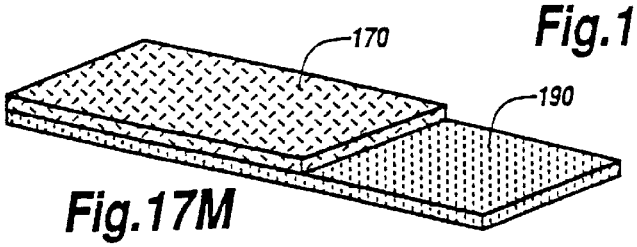
FIG. 17M is a perspective view of a co-extrusion comprising a layer of anti-corrosion material and a layer of conventional polymeric material.

FIG. 17J is a perspective view of an anti-corrosion layer 170 co-extruded with an anti-microbial layer 180 as indicated at box 351. FIG. 17K is a perspective view of an anti-corrosion layer 170 co-extruded with an anti-static layer 160 as indicated at box 352. FIG. 17L is a perspective view of an anti-corrosion layer 170 co-extruded with an anti-corrosion layer as indicated at box 350. FIG. 17M is a perspective view of an anti-corrosion layer co-extruded with a conventional layer 190 as indicated at box 351.

Figure 17N:
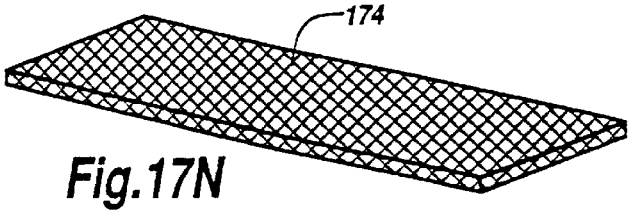
FIG. 17N is a perspective view of an extruded anti-corrosion film.
Figure 17P:
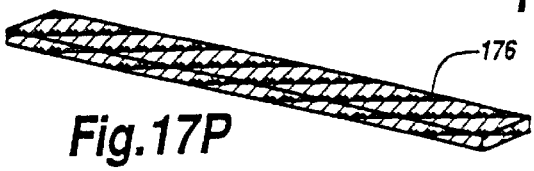
FIG. 17P is a perspective view of an extruded anti-corrosion tape.
Figure 17Q:
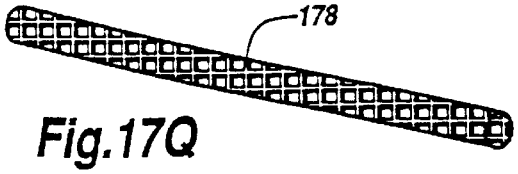
FIG. 17Q is a perspective view of an extruded anti-corrosion filament.
Figures 18A, 18B, 18C, 18D, 18E, 18F, 18G, 18H, 18J:
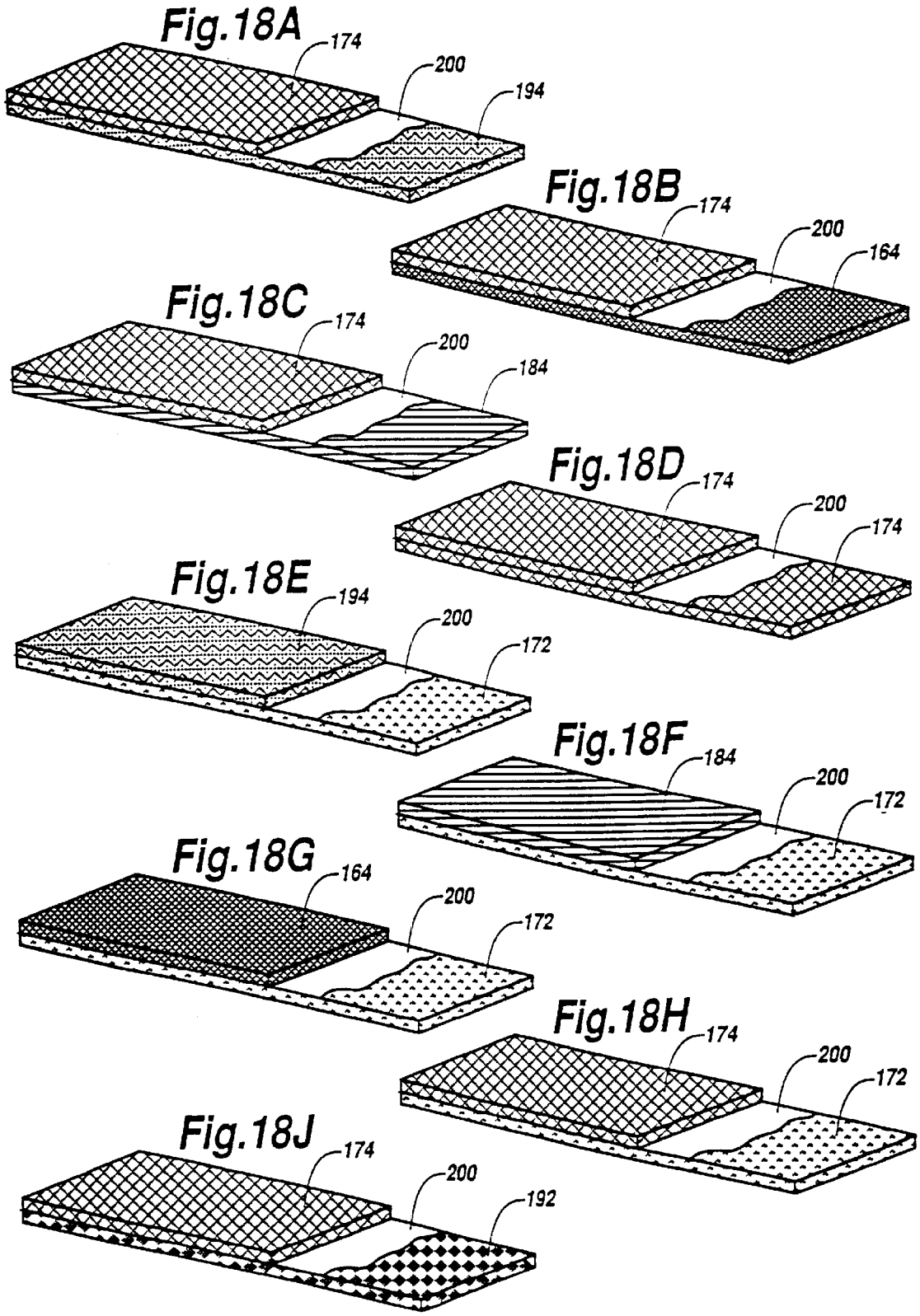
FIG. 18A is a perspective view of an anti-corrosion film laminated onto a conventional film.
FIG. 18B is a perspective view of an anti-corrosion film laminated onto an anti-static film.
FIG. 18C is a perspective view of an anti-corrosion film laminated onto an anti-microbial film.
FIG. 18D is a perspective view of an anti-corrosion film laminated onto an anti-corrosion film.
FIG. 18E is a perspective view of a conventional polymeric film laminated onto an anti-corrosion fabric.
FIG. 18F is a perspective view of an anti-microbial film laminated onto an anti-corrosion fabric.
FIG. 18G is a perspective view of an anti-static film laminated onto an anti-corrosion fabric.
FIG. 18H is a perspective view of an anti-corrosion film laminated onto an anti-corrosion fabric.
FIG. 18J is a perspective view of an anti-corrosion film laminated onto a conventional film.

FIG. 17N is a perspective view of an anti-corrosion film 174 as indicated at box 366. FIG. 17P is perspective view of an anti-corrosion tape 176 as indicated at box 392. FIG. 17Q is a perspective view of an anti-corrosion filament 178 as indicated at box 394.

FIG. 11A is a perspective view of an anti-corrosion film 174 laminated to a conventional film 194 by means of a layer of thermo-plastic adhesive 200 as indicated at box 370. FIG. 11B is a perspective view of an anti-corrosion film 174 laminated to an anti-static film 164 by means of a layer of thermo-plastic adhesive 200 as indicated at box 372. FIG. 11C is a perspective view of an anti-corrosion film 174 laminated to an anti-microbial film 184 by means of a layer of thermo-plastic adhesive 200 as indicated at box 374. FIG. 11D is a perspective view of an anti-corrosion film 174 laminated to an anti-corrosion film 174 by means of a layer of thermo-plastic adhesive 200 as indicated at box 375.

FIG. 11E is a perspective view of a conventional film 194 laminated to an anti-corrosion fabric 172 by means of a layer of thermo-plastic adhesive 200 as indicated at box 446 of FIG. 2B. FIG. 11F is a perspective view of an anti-microbial film 184 laminated to an anti-corrosion fabric 172 by means of a layer of thermo-plastic adhesive 200 as indicated at box 447. FIG. 11G is a perspective view of an anti-static film 164 laminated to an anti-corrosion fabric 172 by means of a layer of thermo-plastic adhesive 200 as indicated at box 450. FIG. 11H is a perspective view of an anti-corrosion film 174 laminated to an anti-corrosion fabric 172 by means of a layer of thermo-plastic adhesive 200 as indicated at box 451. FIG. 11J is a perspective view of an anti-corrosion film 170 laminated to a conventional fabric by means of a layer of thermo-plastic adhesive 200 as indicated at box 454.

As indicated at box 502 of FIG. 2C, the next step in the practice of the present invention comprises the cutting of the anti-corrosion fabric in accordance with a predetermined pattern to provide the pieces necessary to fabricate an anti-corrosion bag. The cutting step of box 502 may be utilized in conjunction with the anti-corrosion fabric of box 406; or with the fabrics comprising an anti-corrosion layer extruded onto a fabric of boxes 326, 327, 328, or 329; or with a fabric having an anti-corrosion coating thereon as depicted in boxes 414 and 415; or with an anti-corrosion fabric having a film laminated thereon as indicated at boxes 446, 448, 450, 451, and 454. In any event, the anti-corrosion fabric is cut utilizing conventional fabric cutting apparatus and in accordance with a predetermined pattern to provide the pieces necessary to fabricate the desired bag configuration.

The next step in the practice of the present invention comprises the sewing step of box 504. As indicated at box 508, certain aspects of the present invention are applicable to conventional bulk bags manufactured from conventional materials in accordance with conventional techniques. Such a conventional bulk bag may be provided with an anti-corrosion liner 509 manufactured in accordance with the present invention.

Box 510 of FIG. 2C, indicates a completed bulk bag assembly. Such a completed bag assembly may comprise the anti-corrosion bag of box 506 provided with a liner which is anti-corrosion also. It will understood, however, that in most instances the anti-corrosion bulk bag of box 506 will not require any accessories and will comprise the completed bulk bag assembly in and of itself.

Figure 3A:
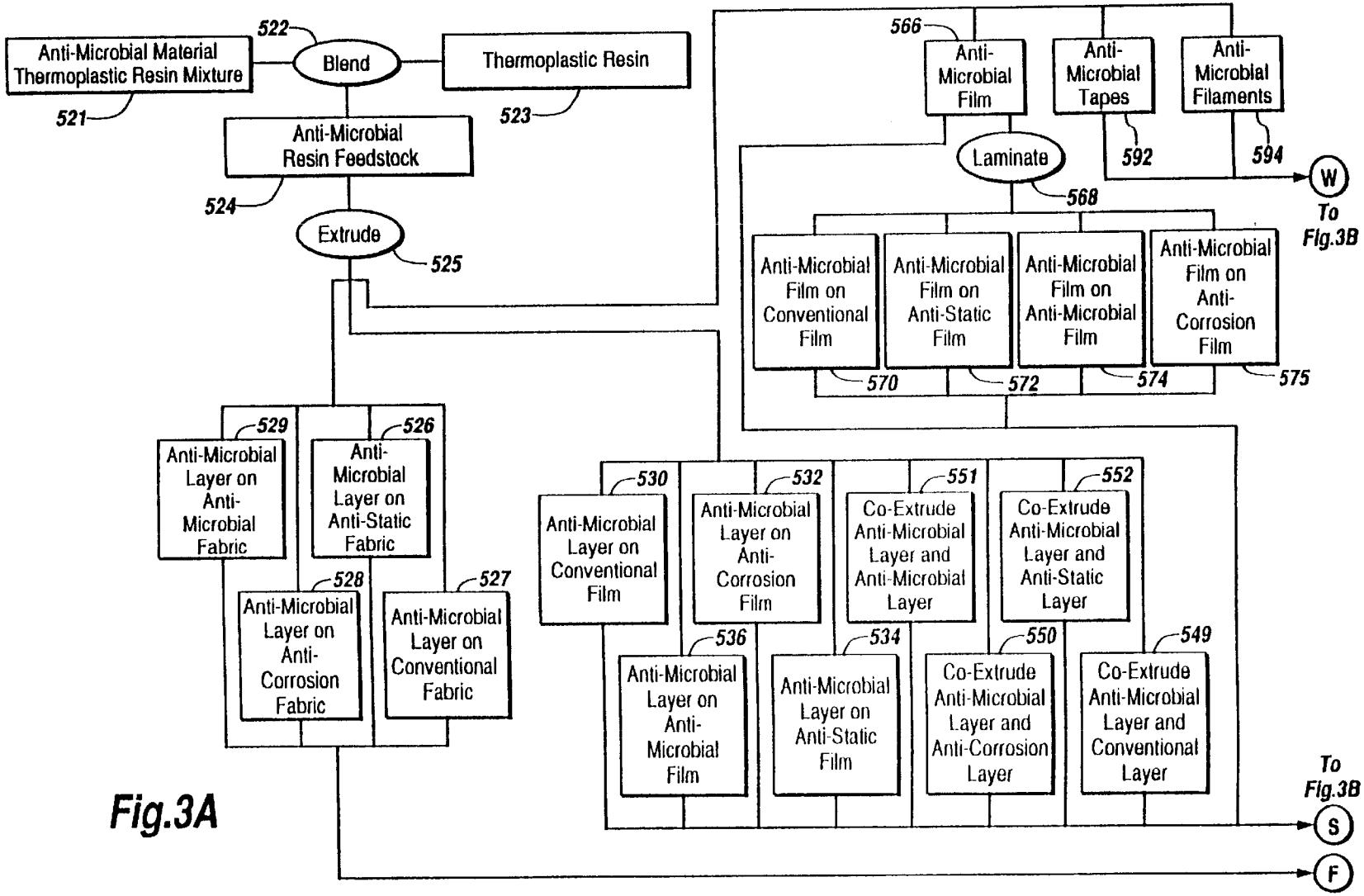
FIGS. 3A, 3B, and 3C comprise a flow chart illustrating numerous alternative methods for producing fabrics, fabric bags, bag liners and bag covers incorporating improved microbial inhibition.
Figure 3B:
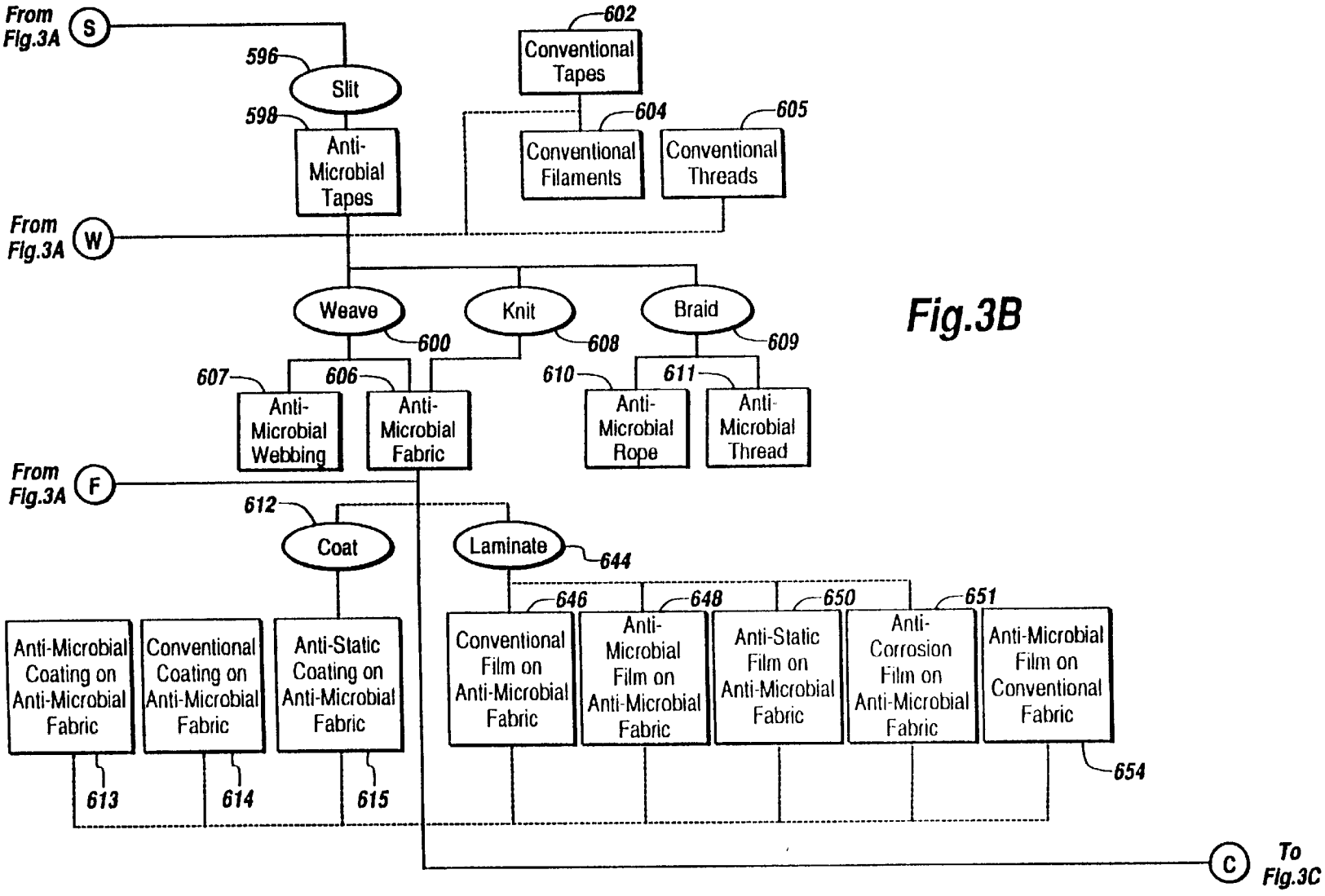
Figure 3C:
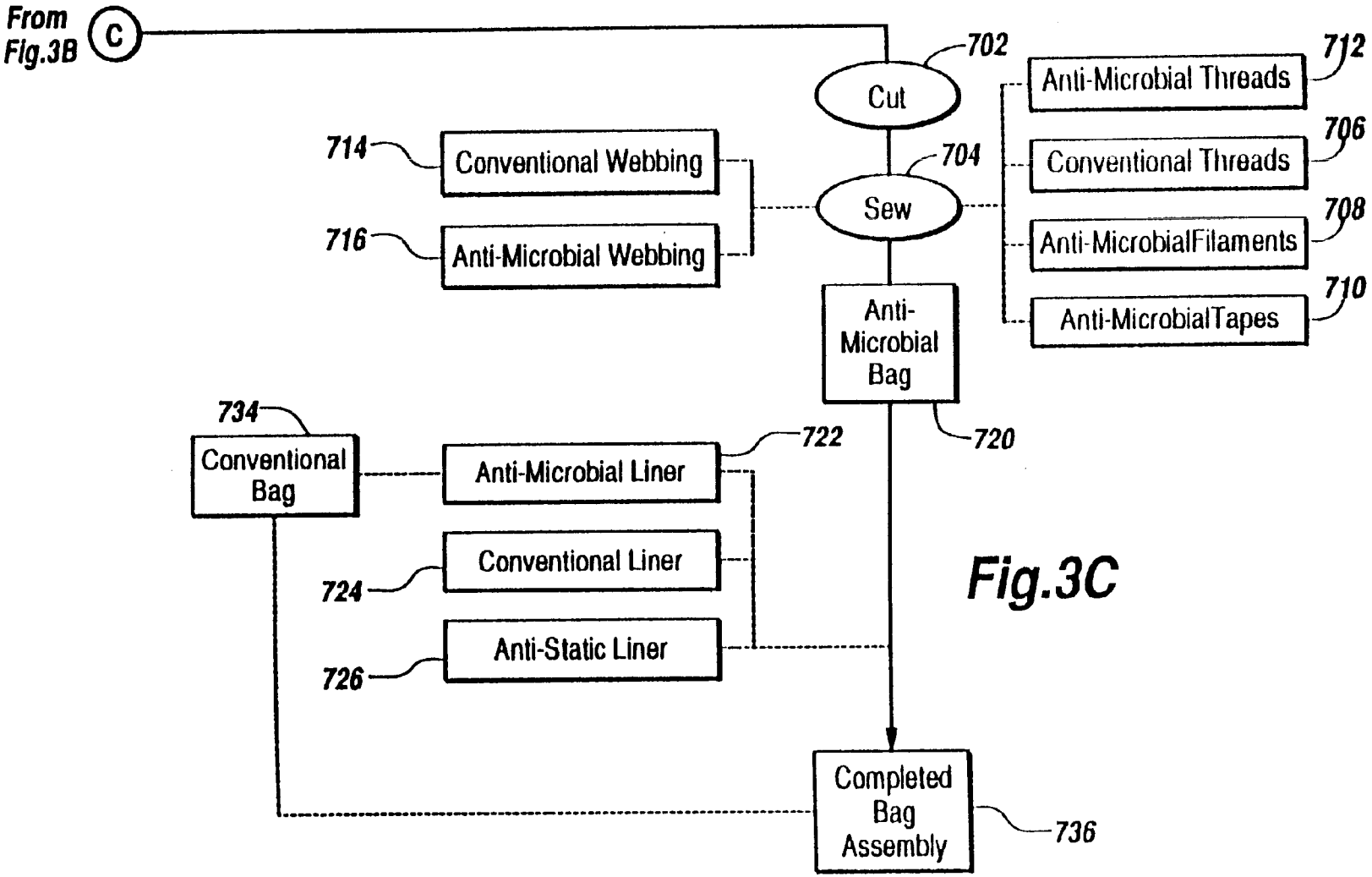

Referring now to the Drawings, FIGS. 3A, 3B, and 3C comprise a flow chart illustrating the use of the present invention in the manufacture of anti-microbial films, fabrics, bulk bags, liners for bulk bags and other articles. Referring particularly to boxes 521, 522, 523, and 524 of FIG. 3A, an anti-microbial material/thermoplastic resin mixture is blended with a thermoplastic resin to form an anti-static resin feedstock. The anti-microbial material used in the mixture of box 521 is preferably of the type distributed by The Microban Products Company of Huntersville, N.C. and identified by the trademark MICROBAN®. Alternatively, the anti-microbial material used in the mixture of box 521 is of the type distributed by HealthShield Technologies LLC of Westport, Conn. and identified by the trademark HealthShield™.

The anti-microbial material/thermoplastic resin mixture of box 521 is blended with the thermoplastic resin of box 523 in conventional blending equipment. The particular thermoplastic resin which is selected for blending with the anti-microbial material/thermoplastic resin mixture of box 521 is preferably of the same general type as the resin comprising the anti-microbial material/thermoplastic resin mixture, and is selected in accordance with the desired melt temperature and the desired melt flow rate utilizing prior art techniques.

The anti-microbial material/thermoplastic resin mixture of box 521 and the thermoplastic resin of box 523 are blended to provide the anti-static resin feedstock of box 524 having anti-microbial characteristics. Referring to box 525, the next step in the practice of the invention comprises the extrusion of the anti-static resin feedstock from box 524 to form anti-microbial film and other anti-microbial articles.

EXAMPLE

Microorganisms are measured in Colony Forming Units per milliliter (CFUs/ml.). This is a count of the individual organisms that grow to form colonies during the contact time. The Assay (+) index and Assay (−) index are used to ensure the test was done properly. The Assay (+) index is used to give an initial concentration of the microorganism and to demonstrate the inoculated system does not inhibit growth. The Assay (−) index demonstrates that the surrounding system is sterile prior to the introduction of microorganisms.

The tests were conducted on untreated and treated samples of polyethylene film. The treated samples were prepared by mixing HealthShield anti-microbial powder with polyethylene resin, then extruding the film in the conventional manner.

All polyethylene film samples were initially given $4.20\times10^5$ CFUs/ml of *E. coli.* On the untreated polyethylene film samples, the *E. coli* grew to a concentration of $4.20\times10^6$ CFUs/ml after 24 hours. The polyethylene film samples treated with 1% HealthShield anti-microbial powder (by weight) had an *E. coli* concentration of $2.00\times10^2$ CFUs/ml after 24 hours, which is a 99.95% reduction. The polyethylene film samples treated with 3% HealthShield anti-microbial powder (by weight) had a 99.99% reduction.

| | |
|---|---|
| Test Articles: | polyethylene film |
| Sample Size: | 2" × 2" |
| Test Organism: | *Escherichia coli* |
| Incubation Period: | 24 hours |

| | Organism Count (CFU/ml) | | |
|---|---|---|---|
| Sample identification | Zero Contact Time | 24 Hours Contact Time | Percent Reduction |
| Assay (+) Control | $4.20 \times 10^5$ | $4.30 \times 10^6$ | No Reduction |
| Assay (−) Control | <10* | <10* | — |
| Untreated Polyethylene Film | $4.20 \times 10^5$ | $3.90 \times 10^6$ | No Reduction |
| Polyethylene Film Treated with 1% HealthShield | $4.20 \times 10^5$ | $2.00 \times 10^2$ | 99.95% |
| Polyethylene Film Treated with 3% HealthShield | $4.20 \times 10^5$ | <10* | 99.99% |

*NOTE: <10 = limit of detection

As indicated in box 526, the extrusion step may be used to form an anti-microbial layer on an anti-microbial fabric, which may comprise either a prior art anti-microbial fabric or an anti-microbial fabric made in accordance with the present invention.

Alternatively, the extrusion step may be used to form an anti-microbial layer on a conventional fabric as indicated at box 527, or to form an anti-microbial layer on an anti-corrosion fabric as indicated at box 528, or to form an anti-microbial layer on an anti-microbial fabric as indicated at box 529, or to form a layer of conventional polymeric material on an anti-microbial fabric. The extrusion step may also be used to form an anti-microbial layer on a conventional polymeric film as indicated at box 530, or to form an anti-microbial layer on an anti-corrosion film as indicated at box 532, or to form an anti-microbial layer on an anti-static film as indicated at box 534, or to form an anti-microbial layer on an anti-microbial film as indicated at box 536. The procedures of boxes 526, 527, 528, 529, 530, 532, 534, and 536 may be carried out as illustrated in FIG. 4 and described hereinabove in connection therewith.

An important aspect of the invention is indicated at boxes 549, 550, 551, and 552 of FIG. 3A and illustrated in FIG. 5. An anti-microbial layer may be co-extruded with a layer of conventional polymeric film, or with an anti-corrosion layer, or with another anti-microbial layer, or with an anti-static layer to provide a co-extruded film useful in the practice of the invention.

Referring again to FIG. 3A, the extrusion step of box 525 may be utilized to form an anti-microbial film as indicated at box 566. The anti-microbial film of box 566 may be utilized directly in subsequent steps of the invention, or as indicated at box 568, the anti-microbial film may be used in the furtherance of lamination procedures also comprising an important aspect of the invention. Specifically, the anti-microbial film of box 566 may be laminated onto a conventional film as indicated at box 570, or onto an anti-static film as indicated at box 572, or onto an anti-microbial film as indicated at box 574, or onto an anti-corrosion film as indicated at box 575. The foregoing procedures are further illustrated in FIG. 6 and described hereinabove in conjunction therewith.

Referring again to FIG. 3A, the extrusion step of box 525 may be used to form anti-microbial tapes as indicated at box 592. The anti-microbial tapes are not entirely unlike the anti-microbial film of box 566, but differ therefrom dimensionally. Whereas the anti-microbial film of box 566 is typically long and wide and characterized by a substantial thickness, the anti-microbial tapes of box 592 are typically relatively long, relatively narrow, relatively thin, and flat in cross section. The anti-microbial tapes of box 592 are dimensionally similar to the polymeric tapes which are conventionally supplied for use in weaving fabrics to be used in the manufacture of flexible, collapsible containers for flowable materials.

As indicated at box 594, the extrusion process of box 525 may also be used to manufacture anti-microbial filaments. The anti-microbial filaments of box 594 are similar to the anti-microbial tapes of box 592 in that they comprise weavable members which may be utilized in conventional weaving apparatus to manufacture fabrics which may in turn be used in the manufacture of flexible, collapsible bags for handling flowable materials. The anti-microbial filaments of box 594 differ from the anti-microbial tapes of box 592 in that, whereas the anti-microbial tapes are typically flat in cross section, the anti-microbial filaments of box 594 are typically round or oval in cross section and therefore resemble conventional threads. The anti-microbial tapes of box 592 and/or the anti-microbial filaments of box 594 may be twisted to form anti-microbial threads, if desired.

The anti-microbial tapes of box 592 may conveniently be thought of as extruded anti-microbial tapes comprising weavable members useful in conventional weaving apparatus to form an anti-microbial fabric. As indicated by box 596 of FIG. 3B, the anti-microbial layers extruded onto the various films of boxes 530, 532, 534, and 536; the anti-microbial layers co-extruded with the various layers of boxes 549, 550, 551, and 552; the anti-microbial film of box 566; and/or the anti-microbial films laminated onto the various films of boxes 570, 572, 574, and 575 may also be utilized to form anti-microbial tapes by means of conventional slitting apparatus. Like the anti-microbial tapes of box 592, the anti-microbial tapes formed in the slitting process of box 596 typically comprise a relatively long, relatively narrow, relatively thin configuration which is flat in cross section. The anti-microbial tapes manufactured by the slitting step of box 596 may be conveniently considered as slit anti-microbial tapes as compared with the extruded anti-microbial tapes of box 592.

Referring to box 600, the next step in the practice of the invention comprises weaving one or more of the weavable members formed in accordance with the present invention and comprising the slit anti-microbial tapes of box 598, the extruded anti-microbial tapes of box 592, the extruded anti-microbial filaments of box 594 and/or anti-microbial threads to manufacture an anti-microbial fabric. As is indicated at boxes 602, 604, and 605 conventional tapes, and/or conventional filaments and/or conventional threads formed from non-anti-microbial polymeric materials may be combined with the weavable anti-microbial members of the present invention to form an anti-microbial fabric, if desired. In such event, the weavable anti-microbial members of the present invention would typically comprise a reduced proportion of the total number of weavable members utilized in the weaving step of box 100 to form an anti-microbial fabric, and typically would be arranged in a grid pattern. Alternatively, the anti-microbial tapes and/or threads of the present invention may be twisted together with conventional tapes or filaments to form anti-microbial threads which may be used in the weaving step.

As indicated at boxes 606 and 607, the results of the weaving step of box 600 is either anti-microbial fabric or anti-microbial webbing. Depending on which of the procedures of the present invention is used to fabricate the weavable members which are used in the weaving step of box 600, the anti-microbial fabric of box 606 and/or the anti-microbial webbing of box 607 may be comprised either entirely of anti-microbial material, or of an anti-microbial material which is either extruded onto a polymeric fabric or film, co-extruded with a polymeric layer, or may comprise an anti-static film that is laminated onto a polymeric film. Weavable members formed from conventional polymeric materials may be combined with weavable members formed in accordance with the present invention in carrying out the weaving step, if desired. In any event, the anti-microbial fabric of box 606 and the anti-microbial webbing of box 607 are characterized by a predetermined anti-microbial level which is selected in accordance with the utilization that will ultimately be made of the anti-microbial fabric.

Referring to box 608, the anti-microbial materials of the present invention, whether singly, in combination with other anti-microbial materials of the present invention, or in combination with conventional tapes and/or filaments may be utilized in the knitting of anti-microbial fabric. The knitting step of box 608 is useful when the resulting fabric does not require dimensional stability. As indicated at box 609, the anti-microbial tapes and/or filaments of the present invention, either alone or in combination with conventional tapes, filaments, or threads may be braided to make the anti-microbial rope of box 610 or the anti-microbial thread of box 611.

Referring now to FIG. 3B and particularly to box 612, the next step in the practice of the invention may optionally comprise the coating of the anti-microbial fabric of box 606 with an anti-static material to provide an anti-static coating on an anti-static fabric as indicated at box 615. The anti-microbial fabric may also be coated with a conventional coating as indicated at box 614 or with an anti-microbial coating as indicated at box 613. The coating step may also be used to apply a layer of anti-corrosion material to an anti-microbial fabric, or to apply a layer of anti-microbial material to a conventional polymeric fabric. The coating step of 612 may be carried out utilizing various conventional procedures, as shown in FIGS. 7 and 8 and described hereinabove in conjunction therewith. When an anti-microbial coating is used, the coating material preferably comprises an otherwise conventional polymeric coating material having about 3% (by weight) of the above-identified HealthShield anti-microbial material mixed therein.

An optional laminating step comprising the present invention is also illustrated in FIG. 3B at box 644. The laminating step may be carried out as described hereinabove in connection with FIG. 6, and may be used to laminate a conventional film onto an anti-microbial fabric as indicated at box 646 or to laminate an anti-microbial film onto an anti-microbial fabric as indicated at box 648, or to laminate an anti-microbial film onto a anti-microbial fabric as indicated at box 650 or to laminate an anti-corrosion film onto an anti-microbial fabric as indicated at box 651.

The laminating step of box 644 may also be utilized to laminate an anti-microbial film onto a conventional fabric, as shown at box 654. The anti-microbial film may be manufactured in accordance with the invention by the extrusion process of box 525 of FIG. 3A to provide the anti-microbial film of box 566. The laminating process may be carried out in accordance with the procedure described in accordance with FIG. 6.

Figure 19A:
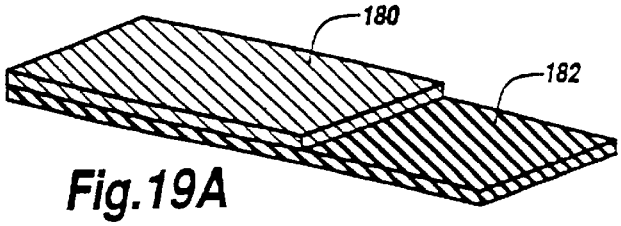
FIG. 19A is a perspective view of an anti-microbial layer extruded onto an anti-microbial fabric.
Figure 19B:
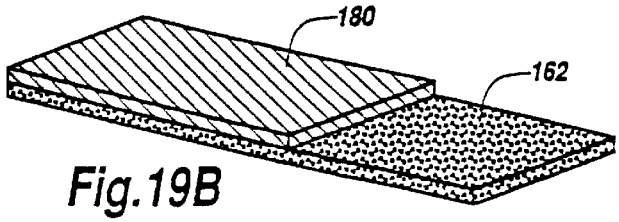
FIG. 19B is a perspective view of an anti-microbial layer extruded onto an anti-static fabric.
Figure 19C:
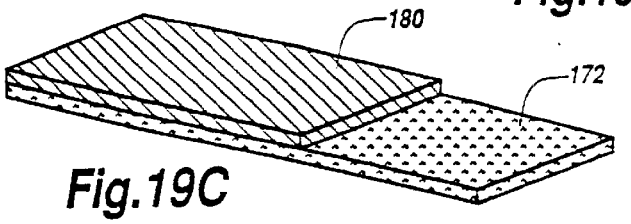
FIG. 19C is a perspective view of an anti-microbial layer extruded onto an anti-corrosion fabric.
Figure 19D:
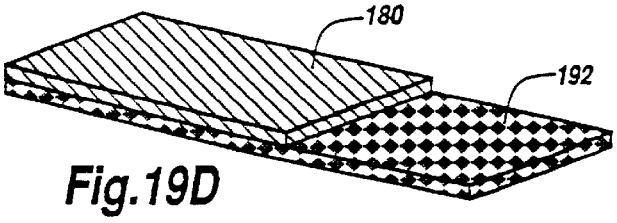
FIG. 19D is a perspective view of an anti-microbial layer extruded onto a conventional fabric.
Figure 19E:
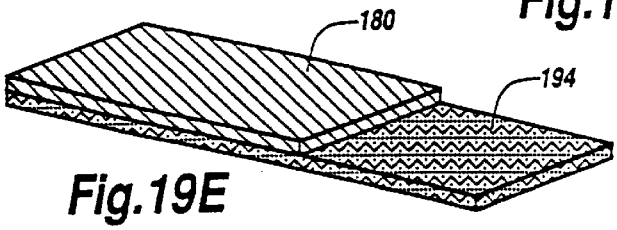
FIG. 19E is a perspective view of an anti-microbial layer extruded onto a conventional film.
Figure 19F:
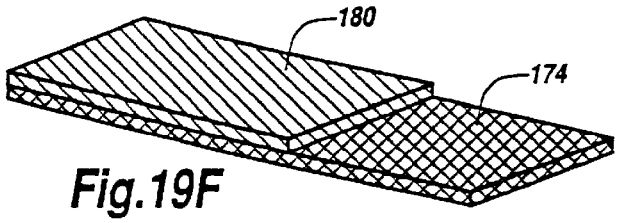
FIG. 19F is a perspective view of an anti-microbial layer extruded onto an anti-corrosion film.
Figure 19G:
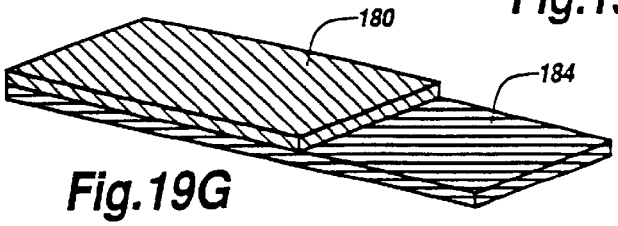
FIG. 19G is a perspective view of an anti-microbial layer extruded onto an anti-microbial film.
Figure 19H:
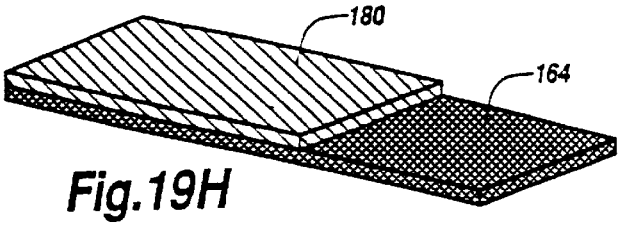
FIG. 19H is a perspective view of an anti-microbial layer extruded onto an anti-static film.

The results of the foregoing steps comprising the present invention are illustrated in FIGS. 9A through 9D, inclusive; FIGS. 19A through 19Q, inclusive; and FIGS. 20A through 20J, inclusive. Referring first to FIG. 9A, there is shown an anti-static layer 160, an anti-static fabric 162, an anti-static film 164, an anti-static tape 166, and an anti-static filament 168. In FIG. 9B there is shown an anti-corrosion layer 170, an anti-corrosion fabric 172, an anti-corrosion film 174, an anti-corrosion tape 176, and an anti-corrosion filament 178. FIG. 9C illustrates an anti-microbial layer 180, an anti-microbial fabric 182, an anti-microbial film 184, an anti-microbial tape 186, and an anti-microbial filament 188. In FIG. 9D there is shown a conventional layer 190, a conventional fabric 192, a conventional film 194, a conventional tape 196, and a conventional filament 198.

FIG. 19A comprises a perspective view of an anti-microbial layer 180 extruded onto an anti-microbial fabric 182 as indicated at box 529 of FIG. 3A. FIG. 19B is a perspective view of an anti-microbial layer 180 extruded onto an anti-static fabric 162 as indicated at box 526. FIG. 19C is a perspective view of an anti-microbial layer 180 extruded onto an anti-corrosion fabric 172 as indicated at box 528. FIG. 19D is a perspective view of an anti-microbial layer 180 extruded onto a conventional fabric 192 as indicated at box 527. FIG. 19E is a perspective view of an anti-microbial layer 180 extruded onto a conventional film 194 as indicated at box 530. FIG. 19F is a perspective view of an anti-microbial layer extruded onto an anti-corrosion film 174 as indicated at box 532. FIG. 19G is a perspective view of an anti-microbial layer extruded onto an anti-microbial film 184 as indicated at box 536. FIG. 19H is a perspective view of an anti-static layer 190 extruded onto an anti-microbial film 164 as indicated at box 534.

Figure 19J:
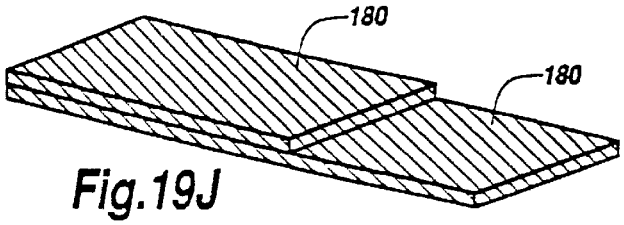
FIG. 19J is a perspective view of a co-extrusion comprising a layer of anti-microbial material and a layer of anti-microbial material.
Figure 19K:
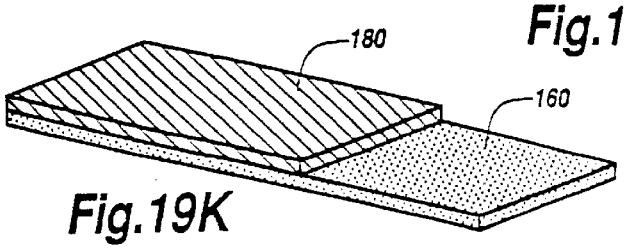
FIG. 19K is a perspective view of a co-extrusion comprising a layer of anti-microbial material and a layer of anti-static material.
Figure 19L:
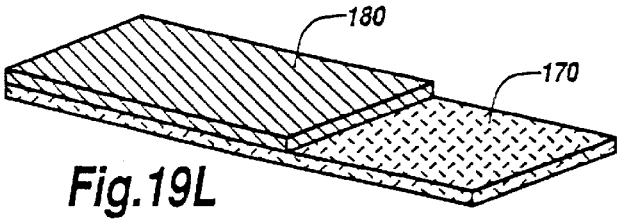
FIG. 19L is a perspective view of a co-extrusion comprising a layer of anti-microbial material and a layer of anti-corrosion material.
Figure 19M:
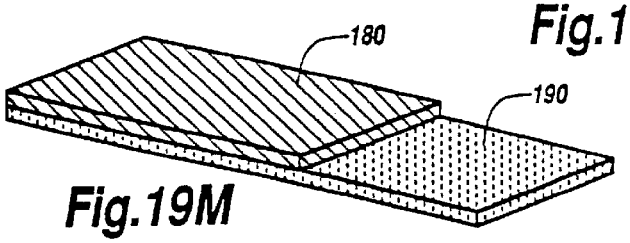
FIG. 19M is a perspective view of a co-extrusion comprising a layer of anti-microbial material and a layer of conventional polymeric material.
Figure 19N:
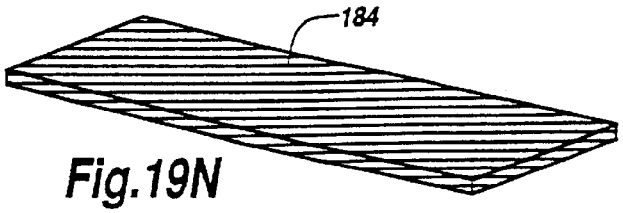
FIG. 19N is a perspective view of an extruded anti-microbial film.
Figure 19P:
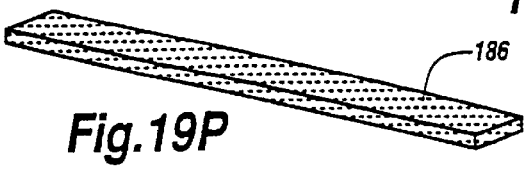
FIG. 19P is a perspective view of an extruded anti-microbial tape.
Figure 19Q:
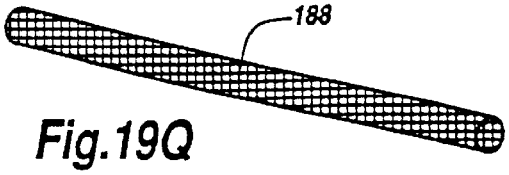
FIG. 19Q is a perspective view of an extruded anti-microbial filament.

FIG. 19J is a perspective view of an anti-microbial layer 180 co-extruded with an anti-microbial layer 180 as indicated at box 551. FIG. 19K is a perspective view of an anti-microbial layer 180 co-extruded with an anti-static layer 160 as indicated at box 552. FIG. 19L is a perspective view of an anti-microbial layer 180 co-extruded with an anti-corrosion layer as indicated at box 550. FIG. 19M is a perspective view of an anti-microbial layer 180 co-extruded with a conventional layer 190 as indicated at box 541. FIG. 19N is a perspective view of an anti-microbial film 184 as indicated at box 566. FIG. 19P is perspective view of an anti-microbial tape 186 as indicated at box 592. FIG. 19Q is a perspective view of an anti-microbial filament 188 as indicated at box 594.

Figures 20A, 20B, 20C, 20D, 20E, 20F, 20G, 20H, 20J:
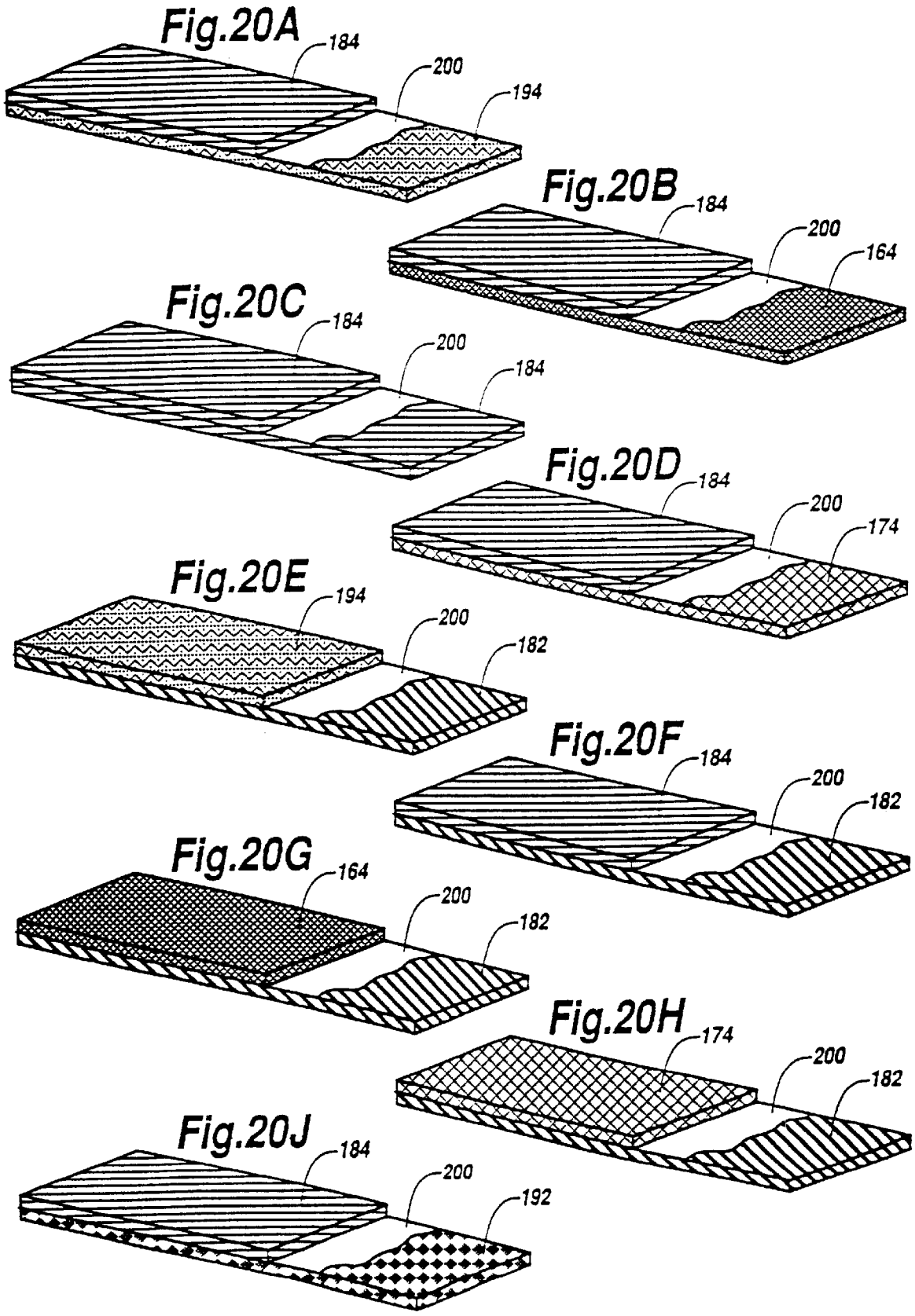
FIG. 20A is a perspective view of an anti-microbial film laminated onto a conventional film.
FIG. 20B is a perspective view of an anti-microbial film laminated onto an anti-static film.
FIG. 20C is a perspective view of an anti-microbial film laminated onto an anti-microbial film.
FIG. 20D is a perspective view of an anti-microbial film laminated onto an anti-corrosion film.
FIG. 20E is a perspective view of a conventional polymeric film laminated onto an anti-microbial fabric.
FIG. 20F is a perspective view of an anti-microbial film laminated onto an anti-microbial fabric.
FIG. 20G is a perspective view of an anti-static film laminated onto an anti-microbial fabric.
FIG. 20H is a perspective view of an anti-corrosion film laminated onto an anti-microbial fabric.
FIG. 20J is a perspective view of an anti-microbial film laminated onto a conventional film.

FIG. 20A is a perspective view of an anti-microbial film 184 laminated to a conventional film 194 by means of a layer of thermo-plastic adhesive 200 as indicated at box 570. FIG. 20B is a perspective view of an anti-microbial film 184 laminated to an anti-static film 164 by means of a layer of thermoplastic adhesive 200 as indicated at box 572. FIG. 20C is a perspective view of an anti-microbial film 184 laminated to an anti-microbial film 184 by means of a layer of thermo-plastic adhesive 200 as indicated at box 574. FIG. 20D is a perspective view of an anti-microbial film 184 laminated to an anti-corrosion film 174 by means of a layer of thermo-plastic adhesive 200 as indicated at box 575.

FIG. 20E is a perspective view of a conventional film 194 laminated to an anti-microbial fabric 182 by means of a layer of thermo-plastic adhesive 200 as indicated at box 646 of FIG. 3B. FIG. 20F is a perspective view of an anti-microbial film 184 laminated to an anti-microbial fabric 182 by means of a layer of thermo-plastic adhesive 200 as indicated at box 648. FIG. 20G is a perspective view of an anti-static film 164 laminated to an anti-microbial fabric 182 by means of a layer of thermo-plastic adhesive 200 as indicated at box 650. FIG. 20H is a perspective view of an anti-corrosion film laminated to an anti-microbial fabric 182 by means of a layer of thermo-plastic adhesive 200 as indicated at box 651. FIG. 20J is a perspective view of an anti-microbial film 184 laminated to a conventional fabric 192 by means of a layer of thermo-plastic adhesive 200 as indicated at box 654.

As indicated at box 702 of FIG. 3C, the next step in the practice of the present invention comprises the cutting of the anti-microbial fabric in accordance with a predetermined pattern to provide the pieces necessary to fabricate an anti-microbial bulk bag. The cutting step of box 702 may be utilized in conjunction with the anti-microbial fabric of box 606; or with the fabrics comprising an anti-microbial layer extruded onto a fabric of boxes 526, 527, 528, or 529; or with a fabric having an anti-microbial coating thereon as depicted in boxes 613, 614 and 615; or with a fabric having a film laminated thereon which may have been provided with micropores as indicated at boxes 646, 648, 650, 651, and 654. In any event, the anti-microbial fabric is cut utilizing conventional fabric cutting apparatus and in accordance with a predetermined pattern to provide the pieces necessary to fabricate the desired bulk bag configuration.

The next step in the practice of the present invention comprises the sewing step of box 704. The sewing step of box 704 incorporates a variety of options. For example, the sewing step of the present invention may be carried out utilizing conventional threads as indicated at box 706. Alternatively, the sewing step may be carried out utilizing anti-microbial filaments as indicated at box 708. The anti-microbial filaments of box 708 may be fabricated in accordance with the present invention as indicated at box 594, or utilizing conventional techniques. Still another alternative is the utilization of anti-microbial tapes in the sewing step of box 704 as indicated at box 710. Like the anti-microbial filaments of box 708, the anti-microbial tapes may be fabricated in accordance with the present invention either as indicated at box 592 or as indicated at box 598, or the anti-microbial tapes of box 710 may be fabricated utilizing conventional techniques. Anti-microbial threads may also be used as indicated at box 712. A further option in the furtherance of the sewing step illustrated at box 704 is the selection of the webbing to be used in the construction of anti-microbial bags incorporating the present invention. As indicated at box 714, conventional webbing may be utilized in the practice of the invention. Alternatively, anti-microbial webbing may be utilized in the practice of the invention as indicated at box 716. If anti-microbial webbing is employed in the sewing step of box 704, the selected anti-microbial webbing may be manufactured either in accordance with the present invention or in accordance with prior art techniques.

As indicated at box 720, the completion of the sewing step of box 704 results in the construction of the completed anti-microbial bulk bag. In most instances the anti-microbial bulk bag resulting from the completion of the sewing step of box 704 will be utilized as is. That is, no liner, cover, or other accessory will be needed in order to provide an anti-microbial bulk bag which fully complies with the requirements of a particular utilization of the invention. However, in some instances it may be considered desirable to provide the anti-microbial bulk bag of box 720 with a liner and/or with a cover.

As indicated at box 722, the anti-microbial bulk bag of box 720 may be provided with an anti-microbial liner manufactured in accordance with the present invention. As indicated at box 724, the anti-microbial bulk bag of box 720 may be provided with a conventional liner, which typically will comprise a length of thermoplastic material extruded in the form of a tube having a diameter matched to the interior dimensions of the anti-static bag in which it will be used. As indicated at box 726, the anti-microbial bag of box 720 may be provided with an anti-static liner comprising a length of anti-microbial material extruded pursuant to the extruding step of box 25 of FIG. 1A in the form of a tube having a diameter matched to the interior directions of the anti-microbial bulk bag in which it will be used.

As indicated at box 734, certain aspects of the present invention are applicable to conventional bulk bags manufactured from conventional materials in accordance with conventional techniques. As indicated by box 722, such a conventional bulk bag may be provided with an anti-microbial liner manufactured in accordance with the present invention.

Box 736 of FIG. 3C indicates a completed bulk bag assembly. Such a completed bulk bag assembly may comprise the anti-static bulk bag of box 720 provided with a liner which is either anti-microbial, conventional, or anti-static in nature. As an alternative, the completed bag assembly of box 736 may comprise the conventional bulk bag of box 734 provided with either an anti-microbial liner or an anti-static liner. It will be understood, however, that in most instances the anti-static bag of box 190 will not require any accessories and will comprise the completed bag assembly in and of itself.

Figure 12:
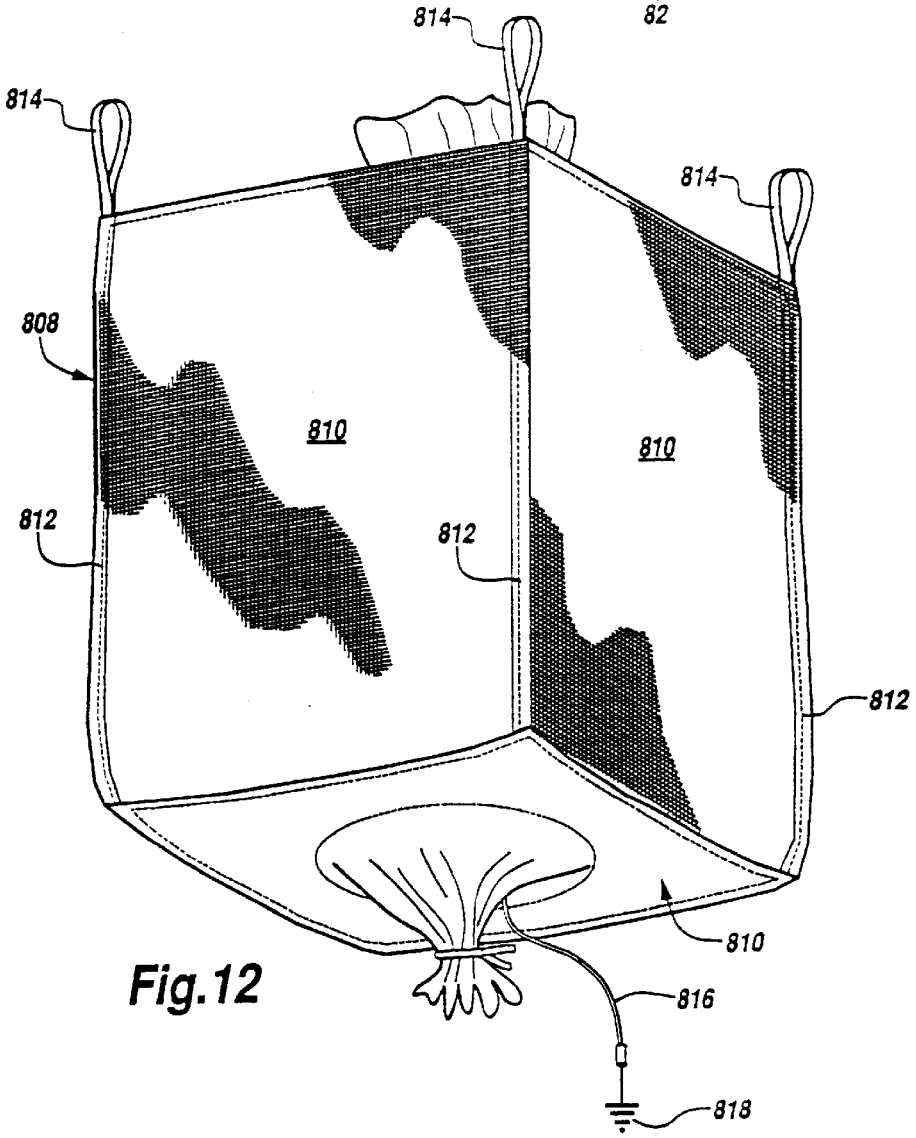
FIG. 12 is a perspective view of a flexible, collapsible receptacle (bag) fabricated from any of the aforementioned fabrics.

Referring now to FIG. 12, there is a bag 808 manufactured in accordance with the present invention. The particular bag 808 illustrated in FIG. 12 is of the type commonly referred to as a bulk bag. It will be understood, however, that the present invention is adapted to provide anti-static, anti-corrosion, and/or anti-microbial characteristics to all types of flexible, collapsible receptacles and is not limited to bulk bags. The bulk bag 808 comprises a plurality of fabric panels 810 each constructed in accordance with the present invention.

The fabric panels 810 comprising the bulk bag 808 are joined together by sewing as indicated by the sewing lines 812. The sewing step may include the use of conventional threads, filaments, or tapes, and/or the use of anti-static or anti-microbial filaments, tapes, or threads. The sewing procedure further includes the connection of lift loops 814 to the fabric panels 810 comprising the bulk bag 808. The lift loops may be either anti-static, or anti-microbial, or conventional in nature.

Depending on the nature of the material to be contained within the bulk bag 808, and further depending upon the resistivity of the fabric panels 810 utilizing construction thereof, it may be considered necessary or desirable to ground the bag 808. In such instances a grounding lead 816 is connected between a source of ground potential 818 and the fabric panels 810 comprising the bag 808, preferably at an interior location. Various prior techniques may be utilized to electrically interconnect the various panels 810 comprising the bag 808, if desired.

Figure 13:
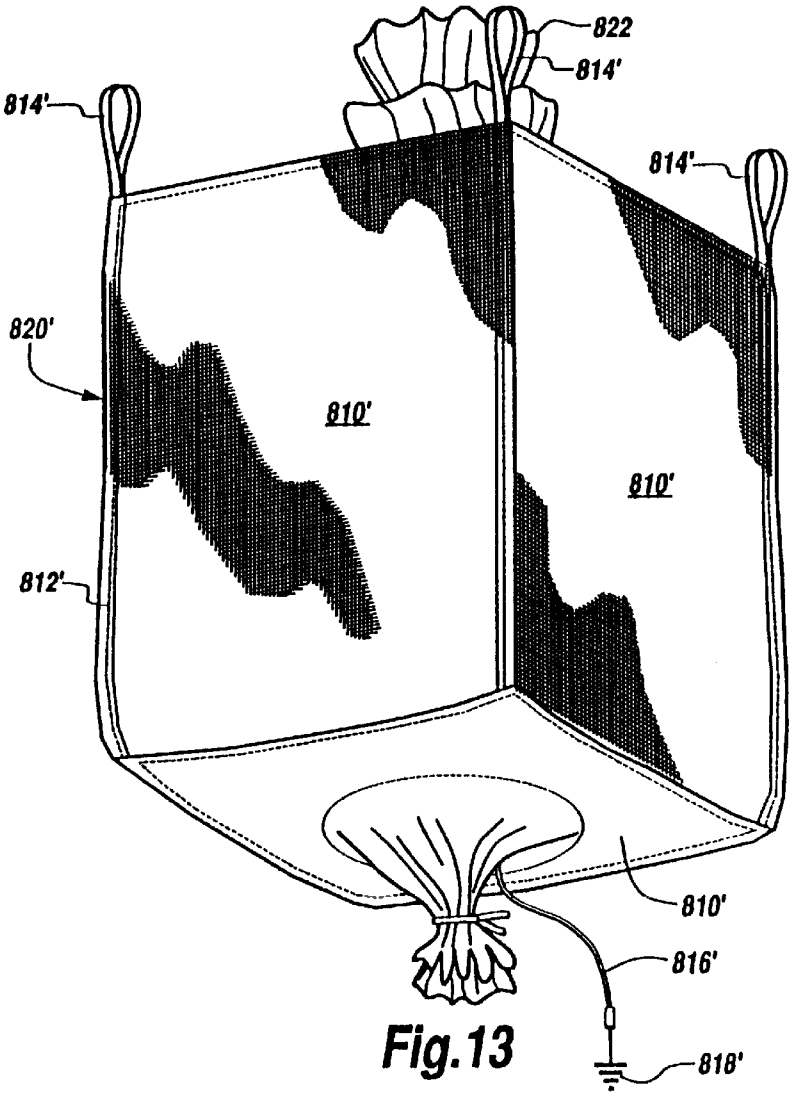
FIG. 13 is a perspective view of a bag incorporating a polymeric liner.

Referring to FIG. 13, there is shown a bulk bag 820 incorporating the present invention. Many of the component parts of the bag 820 are substantially identical in construction and function to component parts of the bag 808 illustrated in FIG. 12 and described hereinabove in conjunction therewith. Such identical component parts are indicated in FIG. 13 by the same reference numerals utilized in the foregoing description of the bag 808, but are differentiated therefrom by means of a prime (') designation.

The bulk bag 820 differs from the bulk bag 808 in that the bulk bag 820 is provided with a liner 822. The liner 822 is conventional in shape and configuration in that it comprises a length of tubing having a diameter matched to the interior dimensions of the bag 820. The length of tubing is gathered at the upper and lower ends so that it may be extended through the filling and discharge openings of the bulk bag 820.

The liner 822 contained within the bag 820 may comprise an anti-microbial liner constructed in accordance with the present invention. Alternatively, the liner 822 may comprise an anti-static liner constructed in accordance with the present invention. The liner 822 may comprise an anti-corrosion liner manufactured in accordance with the invention. The liner 822 may also comprise a conventional liner contained within either an anti-static bag or an anti-microbial bag constructed in accordance with the present invention.

Figure 14:
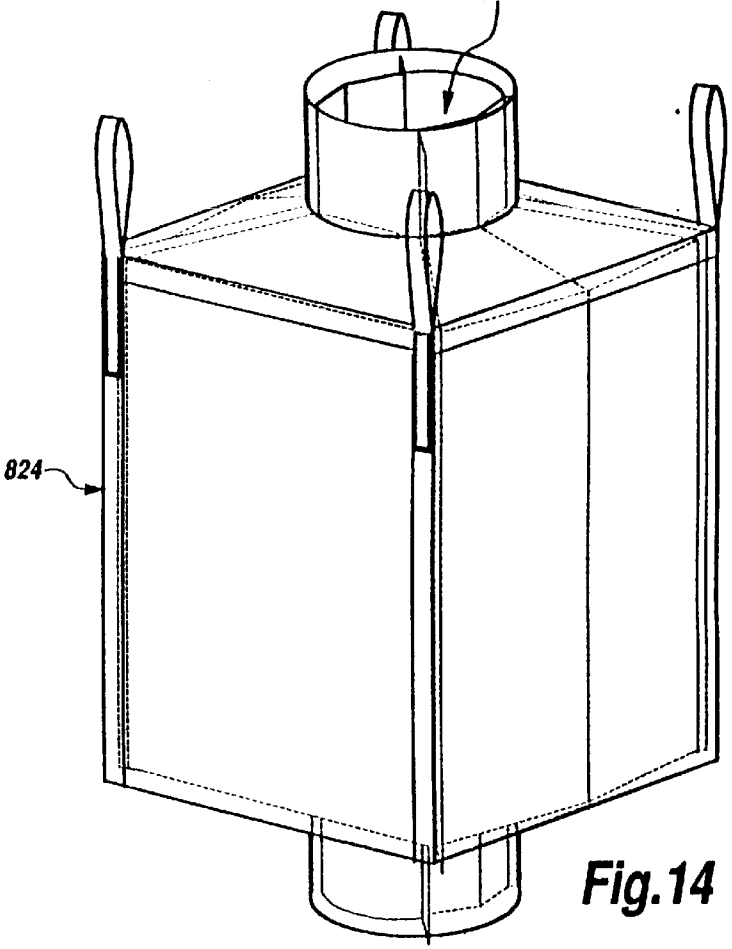
FIG. 14 is a perspective view of a bag incorporating a gusseted polymeric liner.

Referring to FIG. 14, there is shown an anti-static bulk bag 824 constructed in accordance with the present invention and having a liner 826 contained therein. The liner 826 differs from the liner 822 of FIG. 13 in that rather than comprising a continuous hollow tube of uniform diameter throughout its length, the liner 826 is tailored to closely match the interior dimensions of the bag 824, both at the upper and lower ends thereof and in the midportion which comprises most of the volume of the bag 824 and which has interior dimensions which greatly exceed those of the filling and discharge spouts at the upper and lower ends of the bag 824. The liner 826 is preferably manufactured in accordance with the present invention, and further in accordance with the disclosure of the co-pending Application of Norwin C. Derby filed Apr. 27, 1995, Ser. No. 08/429,776, the disclosure of which is incorporated herein by reference as if fully set forth herein.

Figure 15:
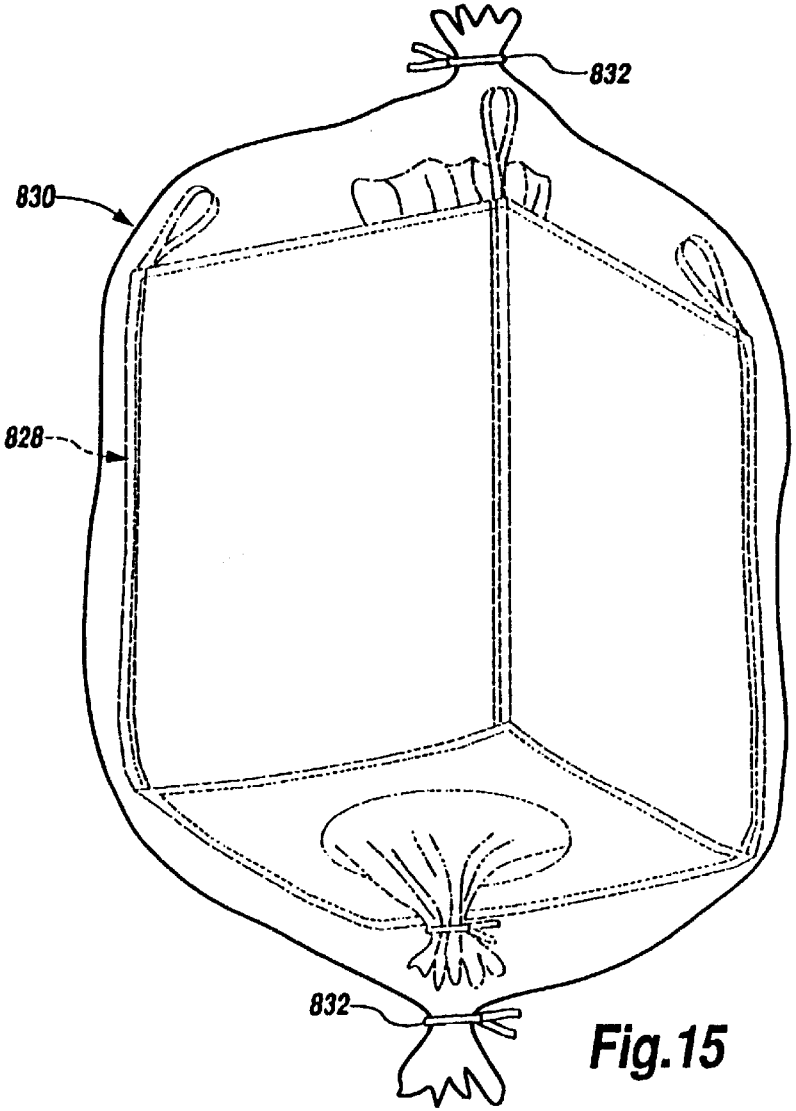
FIG. 15 is a perspective view of a bag with a polymeric tube cover.

FIG. 15 illustrates a bulk bag 828 constructed in accordance with the present invention which is contained within a cover 830. Cover 830 comprises a hollow tube of uniform diameter throughout the length which is gathered at its upper and lower ends and secured by suitable fasteners 832. Since the lift loops of the bag 828 are contained within the cover 830, the embodiment of the present invention illustrated in FIG. 15 is preferably utilized with a conventional pallet, whereby the bag and the cover may be lifted without requiring access to the lift loops of the bag.

As indicated at box 228 of FIG. 1C, the bag 828 may comprise the anti-static bag of box 220 and the cover 830 may comprise a conventional cover.

Alternatively, as indicated at box 230, cover 830 may comprise an anti-static cover manufactured from an anti-static material in accordance with the present invention. The cover 830 may also comprise a cover form from an anti-microbial material manufactured in accordance with the present invention as indicated at box 232.

Figure 16:
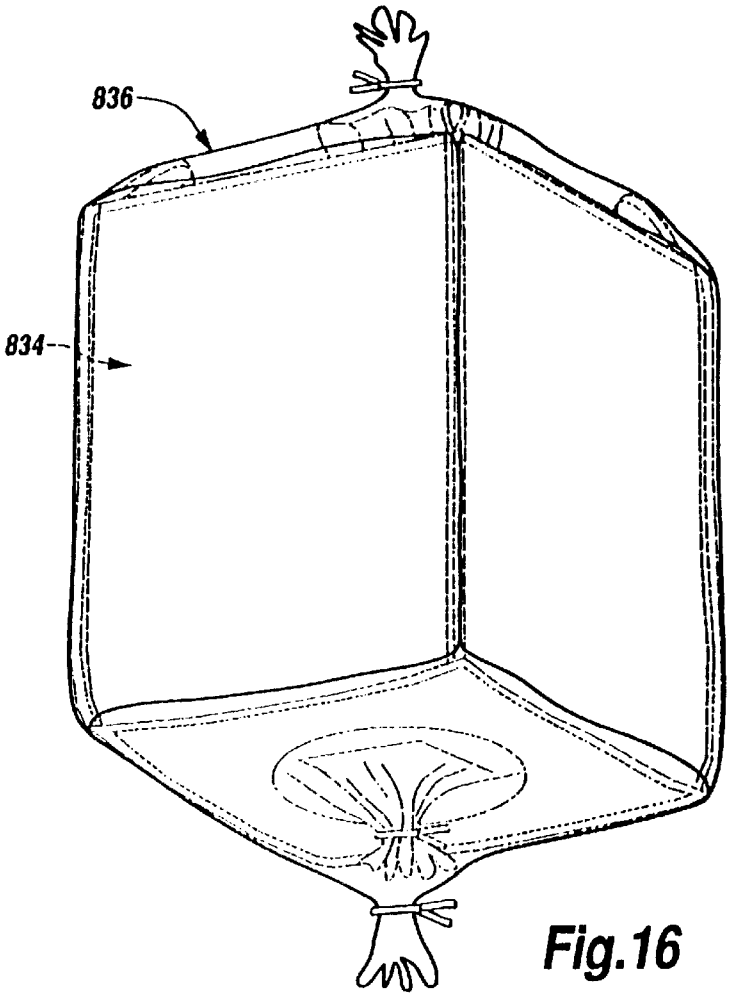
FIG. 16 is a perspective view of a bag with a polymeric form fit cover.

FIG. 16 illustrates a bulk bag 834 constructed in accordance with present invention and contained within a cover 836. The cover 836 of FIG. 16 differs from the cover 830 of FIG. 15 primarily in the fact that the cover 836 is manufactured from a plurality of pre-cut pieces and thereby tailored to have interior dimensions that closely match the exterior dimensions of the bag 834. The various pieces comprising the cover 836 may be joined one to the other by conventional techniques, such as heat sealing and/or gluing.

As indicated by box 228 of FIG. 1C, the cover 836 may be conventional in nature and be used to contain the anti-static bag of box 220. Alternatively, the cover 836 may be fabricated from an anti-static material in accordance with the present invention as indicated by box 230. The cover 836 may also be fabricated from an anti-microbial material manufactured in accordance with the present invention as indicated at box 232.

Referring again to FIG. 3A, and in particular to box 566, the extended anti-microbial film therein described is utilized in the practice of a fourth embodiment of the invention. The anti-microbial film of box 566 may be cut into sheets of appropriate size and thereafter used as release sheets for hamburger patties and similar food items. The anti-microbial films of box 566 may also be used in the manufacture of liners for bulk bags.

The fourth embodiment of the invention will be further understood by reference to FIG. 3B, and particularly to box 606 thereof. The anti-microbial tapes of box 592 may be woven as disclosed in box 600 to form the anti-microbial fabric of box 606.

Alternatively, the anti-microbial film of box 566 may be slit as disclosed in box 596 to form the anti-microbial tapes of box 598 and then woven as disclosed in box 600 to form the anti-microbial fabric of box 606.

Regardless of which technique is used in its manufacture, the resulting anti-microbial fabrics may be cut as disclosed in box 702 and sewn as disclosed in box 704 to construct the otherwise conventional anti-microbial bulk bag of box 720. The bulk bag of box 720 may be constructed using the threads/filaments/tapes of boxes 706-712, inclusive, and may employ either conventional or anti-microbial webbing as disclosed in boxes 714 and 716. The bulk bag of box 720 may be provided with a conventional liner, or with an anti-microbial liner, or with an anti-static liner as disclosed in boxes 722 through 726, inclusive.

Although preferred embodiments of the invention have been illustrated in the accompanying Drawings as described in the foregoing Detailed Description, it will be understood that the invention is not limited to the embodiments disclosed, but is capable of numerous rearrangements, modifications, and substitutions of parts and elements without departing from the spirit of the invention.

We claim:

1. A method of providing an anti-microbial separation between adjacent food items including the steps of:

providing a quantity of a polymeric resin;

providing a quantity of an anti-microbial agent comprising ionic silver;

mixing the anti-microbial agent with the polymeric resin in a ratio of 3% by weight anti-microbial agent to 97% polymeric resin;

extruding the resulting mixture into an anti-microbial film;

cutting the anti-microbial film into anti-microbial release sheets having predetermined dimensions; and positioning the anti-microbial sheets between adjacent food items to provide an anti-microbial barrier therebetween.

2. A method of manufacturing anti-microbial film including the steps of:

providing a quantity of a polymeric resin;

providing a quantity of an anti-microbial agent comprising ionic silver;

mixing the anti-microbial agent with the polymeric resin in a ratio of 3% by weight of anti-microbial agent to 97% polymeric resin;

extruding the resulting mixture into an anti-microbial film;

slitting the anti-microbial film into long, narrow strips comprising anti-microbial tapes to form an anti-microbial fabric;

cutting the anti-microbial fabric in accordance with a predetermined pattern thereby forming a plurality of individual anti-microbial fabric pieces; and joining the individual anti-microbial fabric pieces edge to edge to form a flexible, collapsible anti-microbial container.

3. A method of manufacturing an anti-microbial flexible intermediate bulk container comprising the steps of:

providing a flexible intermediate bulk container including at least one side wall, at least one bottom wall, and at least one top wall; the side, bottom, and top walls being joined together edge to edge to define a flexible intermediate bulk container having a predetermined capacity;

providing a quantity of a polymeric coating material;

providing a quantity of an anti-microbial agent comprising ionic silver;

mixing the anti-microbial agent into the polymeric coating material in a ratio of 3% by weight anti-microbial agent to 97% polymeric resin to provide an anti-microbial coating material;

applying the anti-microbial coating material to at least a portion of at least one of the walls comprising the flexible intermediate bulk container.

4. The method according to claim 3 wherein the flexible intermediate bulk container comprises an interior surface and an exterior surface and wherein the anti-microbial coating material is applied to substantially the entirety of the interior surface of the flexible intermediate bulk container.

5. The. method according to claim 3 wherein the flexible intermediate bulk container comprises an interior surface and an exterior surface and wherein the anti-microbial coating material is applied to substantially the entirety of the exterior surface of the flexible intermediate bulk container.

6. A method of providing anti-microbial protection for food items including the steps of:

providing a quantity of a polymeric resin;

providing a quantity of an anti-microbial agent comprising ionic silver;

mixing the anti-microbial agent with the polymeric resin in a ratio of 3% by weight anti-microbial agent to 97% polymeric resin;

extruding the resulting mixture into an anti-microbial film;

cutting the anti-microbial film into anti-microbial sheets having predetermined dimensions; and positioning the anti-microbial sheets adjacent to food items to provide anti-microbial protection for the food items.

7. A method of manufacturing anti-microbial food containers including the steps of:

providing a quantity of a polymeric resin;

providing a quantity of an anti-microbial agent comprising ionic silver;

mixing the anti-microbial agent with the polymeric resin in a ratio of 3% by weight anti-microbial agent to 97% polymeric resin;

forming the resulting mixture into a film;

slitting the anti-microbial film into long, narrow strips comprising anti-microbial tapes;

weaving the anti-microbial tapes to form an anti-microbial fabric;

cutting the anti-microbial fabric in accordance with a predetermined pattern thereby forming a plurality of individual anti-microbial fabric pieces; and joining the individual anti-microbial fabric pieces edge to edge to form a food container.

* * * * *